US008177604B2

(12) United States Patent
Ujihara et al.

(10) Patent No.: US 8,177,604 B2
(45) Date of Patent: May 15, 2012

(54) SURFACE ABRADING METHOD OF PHOTOSENSITIVE LAYER OF ELECTROPHOTOGRAPHIC PHOTORECEPTOR

(75) Inventors: Junji Ujihara, Tokyo (JP); Hirohiko Seki, Yamanashi (JP); Nobuaki Kobayashi, Tokyo (JP); Tadaaki Sumitani, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 348 days.

(21) Appl. No.: 12/690,403

(22) Filed: Jan. 20, 2010

(65) Prior Publication Data

US 2010/0197200 A1 Aug. 5, 2010

(30) Foreign Application Priority Data

Jan. 30, 2009 (JP) ..... 2009-019281

(51) Int. Cl.
*B24B 7/30* (2006.01)

(52) U.S. Cl. ..... 451/49; 451/28; 451/41; 451/527

(58) Field of Classification Search ..... 451/28, 451/41, 49, 526–539, 168
See application file for complete search history.

(56) References Cited

U.S. PATENT DOCUMENTS 3,699,726 A * 10/1972 Turner et al. ..... 451/38
4,483,107 A * 11/1984 Tomoyori et al. ..... 451/59
4,599,827 A * 7/1986 Goodwin ..... 451/57
4,720,939 A * 1/1988 Simpson et al. ..... 451/5
4,764,448 A * 8/1988 Yoshitomi et al. ..... 430/119.81
4,922,675 A * 5/1990 Sato et al. ..... 451/539
4,932,165 A * 6/1990 Sone et al. ..... 451/46
5,148,639 A * 9/1992 Sakai et al. ..... 451/59
5,470,271 A * 11/1995 Briggs et al. ..... 451/55
5,667,926 A * 9/1997 Maruyama et al. ..... 430/119.71
5,702,563 A * 12/1997 Salugsugan et al. ..... 438/692
5,899,794 A * 5/1999 Shige et al. ..... 451/41
5,913,716 A * 6/1999 Mucci et al. ..... 451/59
6,004,189 A * 12/1999 Phillips ..... 451/49
6,171,224 B1 * 1/2001 Phillips ..... 492/59
6,634,929 B1 * 10/2003 Visser ..... 451/41
6,776,699 B2 * 8/2004 Amano et al. ..... 451/527
7,198,550 B2 * 4/2007 Ohishi ..... 451/41

FOREIGN PATENT DOCUMENTS

JP 2008216307 9/2008

* cited by examiner

*Primary Examiner* — George Nguyen
(74) *Attorney, Agent, or Firm* — Lucas & Mercanti, LLP

(57) ABSTRACT

A surface abrading method of an electrophotographic photoreceptor is disclosed, comprising abrading the surface of a photosensitive layer with an abrading member entrained about a backup roll with feeding the abrading member and rotating the photoreceptor, while moving the abrading member parallel to a rotating shaft of the photoreceptor with bringing the abrading member into contact with the photosensitive layer surface, wherein the abrading member comprises a solid body on a backing material, the solid body contains abrasive grains and is provided on the backing material brought into contact with the photosensitive layer surface, and the top face of the solid body exhibits a surface roughness (Ry) of from 4.0 to 8.0 μm.

10 Claims, 6 Drawing Sheets

SURFACE ABRADING METHOD OF PHOTOSENSITIVE LAYER OF ELECTROPHOTOGRAPHIC PHOTORECEPTOR

This application claims priority from Japanese Patent Application No. 2009-019281, filed on Jan. 30, 2009, which is incorporated hereinto by reference.

FIELD OF THE INVENTION

The present invention relates to an electrophotographic photoreceptor and in particular to a surface abrading method of a photosensitive layer of an electrophotographic photoreceptor used for electrophotographic image forming apparatus, such as a copier, a laser beam printer or a facsimile.

BACKGROUND OF THE INVENTION

Recently, image processing machines using an electrophotographic image forming apparatus by an electrophotographic image forming process have made remarkable development. An electrophotographic image forming apparatus is one which forms images on a recording medium (for example, recording paper, OHP sheet or the like) by a process of electrophotographic image formation. Examples of such an electrophotographic image forming apparatus include an electrophotographic copying machine, an electrophotographic printer (for example, laser printer, LED printer or the like), a facsimile apparatus, a word processor and their combinations (multi-function printer or the like).

In the past, there were used inorganic photoreceptors employing inorganic compounds such as a selenium compound as a photoreceptor used in a laser printer or a digital copying machine of an electrophotographic image forming apparatus. Recently, there have been used organic photoreceptors employing organic compounds which make it easy to develop materials responsive to light of various wavelengths and also have little impact on the environments.

In an electrophotographic image forming apparatus by a process of electrophotographic image formation (hereinafter, also denoted simply as an image forming apparatus), the outer circumferential surface of a photosensitive layer of a drum-form electrophotographic photoreceptor (hereinafter, also denoted as simply as photoreceptor) which has been uniformly electrostatic-charged, is selectively exposes based on image data to form an electrostatic latent image thereon. The thus formed electrostatic latent image is developed with a toner (developer) by a developing means to form a toner image. Then the toner image is transferred to a recording medium to form then image. Further, after having transferred the toner image, a developer or the like remaining on the outer circumferential surface of the photosensitive layer of the photoreceptor is removed by a cleaning means. The photoreceptor, the outer circumferential surface of which has been cleaned by a cleaning means, is subjected to the next image formation process. Thus, in the outer circumferential surface of a photosensitive layer of a photoreceptor used for image formation in an image forming apparatus, image formation is performed through a series of repeated steps of electrostatic-charging, exposure, development, transfer and cleaning.

In an image forming apparatus by a process of electrophotographic image formation, there has been studied reduction of friction coefficient of the photosensitive layer surface of a photoreceptor with the aim of reducing the remaining toner amount after transfer as well as prevention of adhesion of an unwanted toner. It is known that this renders it difficult to cause cleaning trouble when cleaning a toner remaining on the photosensitive layer without being transferred by a blade or a brush. There are also known environmental effects such that a residual toner amount after transfer is reduced, leading to reduction of the waste toner amount, reduced torque to drive a photoreceptor and reduced electric power consumption of the image forming apparatus.

There is generally known a method of cleaning a residual toner on a photosensitive layer after transfer by a blade formed of urethane rubber or the like, which is brought into contact in the counter direction.

Meanwhile, development of a polymerization toner produced through emulsion polymerization, suspension polymerization or the like has been advanced along with recent demand for higher image quality in the market. However, such a polymerization toner easily causes cleaning trouble, as compared to irregular-shaped toner particles, resulting in image deterioration due to toner filming or fusion and leading to demand for further precise cleaning. The outer surface of a photosensitive layer and a blade, both of which are made of a resin, are insufficient in lubrication, and a blade easily reverses on the smooth surface of the photosensitive layer, often causing cleaning trouble.

To resolve problems of cleaning trouble, there is known addition of a lubricant to the photosensitive layer surface to reduce friction coefficient. Examples of a lubricant include a fluorine-containing resin (hereinafter, also denoted as a fluororesin) such as polytetrafluoroethylene, a spherical acryl resin, a powdery polyethylene, a powdery metal oxide such as silicon oxide or aluminum oxide, and a lubricant liquid such as silicone oil. Specifically, a fluororesin containing a relatively large amount of fluorine atoms exhibits a markedly reduced surface energy and results in enhanced lubricating effects. However, reduction of friction coefficient by these methods often produces problems such that contact with a blade over a long period of time results in a gradual increase of friction coefficient, leading to increased friction with the blade and causing troubles such as abnormal noise of the blade, torsion or the like.

Alternatively, since abrading the photosensitive layer surface of the photoreceptor with an abrasive to roughen the surface results in reduced contact area with the blade and makes it easy to remove foreign materials adhered thereto, Japanese Patent Application JP 2007-192906A describes a method in which surface-roughening of the photoreceptor surface is conducted by a sheet-form abrasive member, called abrasive sheet having a structure of providing abrasive grains dispersed in a resin on a substrate. However, abrasion by use of such an abrasion member of abrasive grain dispersion produced a problem such that the abrasive member surface was clogged with abrasive residue produced in abrasion, rendering it difficult to perform stable abrasion.

To resolve such a problem, for example, there is known an abrasive tape in which agglomerates (aggregative material) containing abrasive grains are regularly arranged to prevent abrasive residues from clogging the abrasive member surface, as described in, for example, JP 2008-216307A.

The use of an abrasive tape described in JP 2008-216307A has proved to be effective to prevent clogging of abrasive residue but led to problems described below:

1. Regular arrangement of abrasive grain-containing agglomerates and point-contact of the top of the agglomerates with the photoreceptor surface easily produces streak-like flaws on abrasion, 2. Production of streak-like flaws on the photoreceptor surface make it difficult to adhere a toner onto the flawed portion, easily causing white flaw troubles, and 3. Highly precise control is required when pressing the abrasive tape against the photoreceptor surface.

In view of the foregoing, there has been desired development of a surface abrasion method of the a photosensitive layer of a photoreceptor which prevents abrasive residue from clogging an abrasive tape, does not require highly precise control when pressing the abrasive tape onto the photoreceptor surface and produces no streak-like flaw on the photoreceptor surface when abrading the photosensitive layer surface of a photoreceptor by an abrasive tape.

SUMMARY OF THE INVENTION

The present invention has come into being in view of the foregoing circumstances. It is an object of the invention to provide a surface abrasion method of the photosensitive layer of a photoreceptor, preventing an abrasive tape from clogging of abrasive residue, requiring no precise control when pressing the abrasive tape onto the photoreceptor surface and producing no streak-like flaw on the photoreceptor surface when abrading the photosensitive layer surface of a photoreceptor by such an abrasive tape.

The foregoing object of the invention was achieved by the following constitution.

Thus, one aspect of the invention is directed to a surface abrading method of an electrophotographic photoreceptor comprising at least a photosensitive layer on an electrically conductive substrate, the method comprising abrading a surface of the photosensitive layer with an abrading member entrained about a backup roll with feeding the abrading member and rotating the electrophotographic photoreceptor, while moving the abrading member parallel to a rotating shaft of the electrophotographic photoreceptor with bringing the abrading member into contact with the surface of the photosensitive layer, wherein the abrading member comprises a solid body on a backing material, the solid body contains abrasive grains and is provided on a side of the backing material which is to be brought into contact with the photosensitive layer surface, and a top face of the solid body which is to be brought into contact with the photosensitive layer surface exhibits a surface roughness (Ry) of from 4.0 μm to 8.0 μm.

According to the present invention, there was provided a surface abrasion method of a photosensitive layer of a photoreceptor which prevents abrasive residue from clogging of an abrasive tape, does not require highly precise control when pressing the abrasive tape onto the photoreceptor surface and produces no streak-like flaw on the photoreceptor surface when abrading the photosensitive layer surface of a photoreceptor by an abrasive tape.

DETAILED DESCRIPTION OF THE INVENTION

Figure 1A:
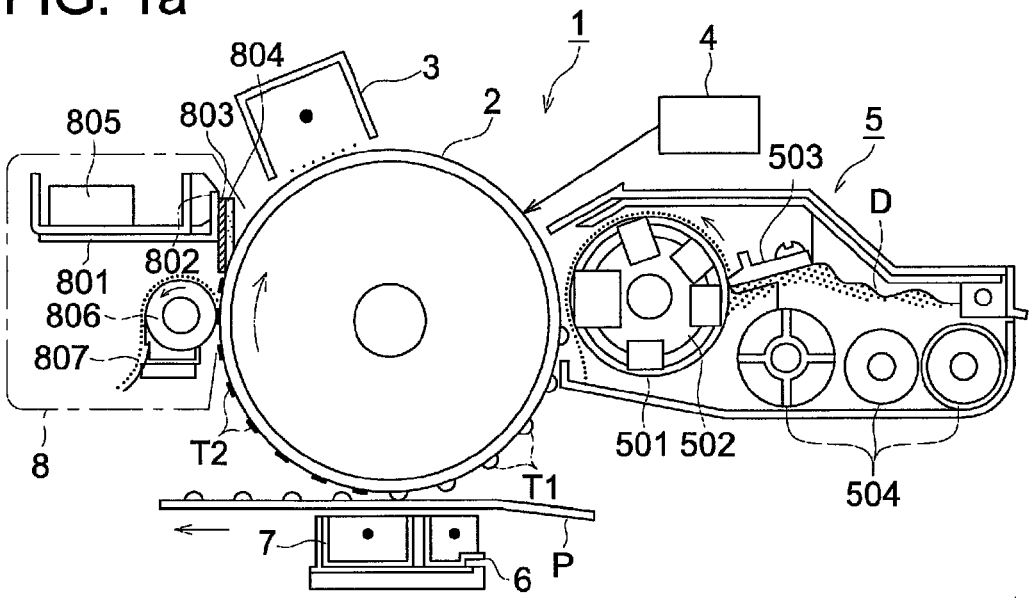
FIGS. 1*a*-1*c* illustrate a constitution of an image forming section of an electrophotographic image forming apparatus.

The present invention relates to a method of abrading the surface of a photosensitive layer of a photoreceptor by using an abrasive tape as an abrasive material so that an increase of friction coefficient between a sealing member and the photosensitive layer surface of the photoreceptor is inhibited and any toner remaining on the photosensitive layer surface and foreign material adhered thereto are stably removed by a blade over a long period of time.

JP 2008-216307A also discloses a method in which, when abrading the surface of a photosensitive layer of a photoreceptor by using an abrasive tape as an abrading member, preventing clogging of abrasive residue inhibited production of streak-like flaws on abrasion; however, there was not disclosed a method of inhibiting occurrence of streak-like flaws produced by an agglomerate (corresponding to a solid body of an abrasive tape related to the invention) including abrasive grains contained in an abrasive tape.

In the invention, there was studied a surface-abrading method of a photoreceptor in which, when abrading the surface of a photosensitive layer of the photoreceptor by using an abrasive tape provided with a solid body containing abrasive grains on a backing material, abrasion was performed without producing streak-like flaws due to the solid body of the abrasive tape and requiring precise control.

In the invention, when abrading the surface of a photosensitive layer of a photoreceptor having the photosensitive layer on an electric-conductive substrate by using a abrasive tape having a solid body containing abrasive grain, abrading was performed by the following constitution:

1. In order to increase a contact area of the top of the solid body containing abrasive grains, which is in contact with the photosensitive layer surface, is increased and also to disperse concentration of pressing pressure to the top of the solid body, there was used an abrasive tape having a shape exhibiting a specific surface roughness;
2. Using an abrasive tape having a width less than that of the photosensitive layer, the photoreceptor was fixed and the abrasive tape entrained about a backup roll is moved in the width direction of the photoreceptor and parallel to the photosensitive layer surface, or the abrasive tape entrained about a backup roll is fixed and the photoreceptor is moved in the width direction of the photosensitive layer;
3. An elastic member was used for the backup roll to achieve uniform pressure when bringing the abrading tape into contact with the photosensitive layer surface.

Accordingly, the foregoing constitution, solved problems in an abrading method using an abrasive tape provided with a solid body containing abrasive grains on a conventional backing material, enabling to provide a method of stably abrading the surface of a photosensitive layer of a photoreceptor. In the invention, the width of a photoreceptor refers to the width in the axis direction of a photoreceptor; and the width of a photosensitive layer refers to the width in the axis direction of a photosensitive layer.

The invention will be further detailed with reference to FIGS. 1-6.

Figure 1B:
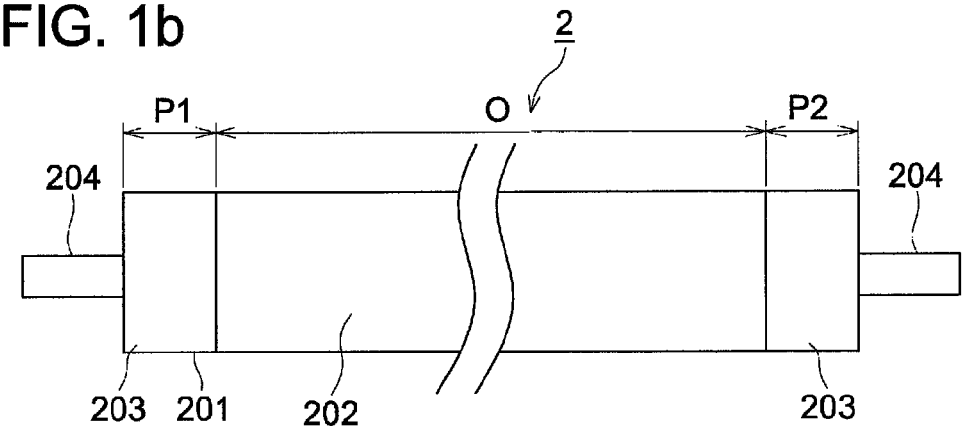
Figure 1C:
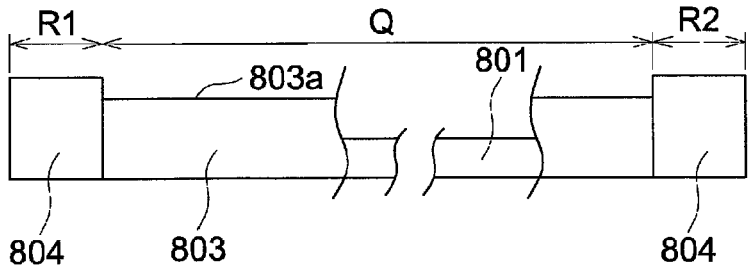

FIGS. 1*a* to 1*c* illustrate a constitution of an image forming section of an electrophotographic image forming apparatus. FIG. 1*a* is a schematic sectional view showing an image forming section of an electrophotographic image forming apparatus. FIG. 1*b* is a schematic plan view of a photoreceptor. FIG. 1*c* is a schematic plan view of a cleaning blade and a sealing member installed in a frame body of a cleaning device, as shown in FIG. 1*a*.

In the FIGS, numeral 1 designates an image forming section. In the image forming section 1 are disposed a photoreceptor 2, an charger 3 providing electrostatic charge, an imagewise-exposure device 4, a developing device 5, a charger 6 as a transfer means to transfer the toner image formed on the circumference surface of the photoreceptor 2 to recording paper from the photoreceptor 2, a charge neutralizer 7 to remove an electric charge on recording paper and separate the recording paper from the photoreceptor 2 and a cleaning device 8 as a cleaning means.

The photoreceptor 2 is provided with a photosensitive layer on a cylindrical substrate formed of an electrically conductive backing material such as aluminum, is rotatably placed in the image forming apparatus and is rotated clockwise, as indicated by the arrow.

The developing device 5 houses a developer D composed of a toner and a carrier, and comprising a development sleeve 501 conveying a developer through rotation in the direction designated by the arrow, a fixed magnet 502 to form ears of the developer to be used for development, a control member to control the amount of the conveyed developer and a developer stirring member 504 to charge a toner mixed with a carrier.

The photoreceptor 2 is uniformly charged by the charger 3 through rotation of the photoreceptor 2 in the direction, as indicated by the arrow and imagewise exposed by the exposure device 4 to form an electrostatic latent image on the photoreceptor 2. The thus formed electrostatic latent image is developed by the developing device 5 to form a toner image T1 on the photoreceptor 2. The formed toner image T1 is transferred onto recording paper P by an electrostatic force produced by charging of the charger 6. Recording paper P is separated from the photoreceptor 2 by the charge neutralizer 7 and conveyed to a fixing device (not shown in the drawing) to be fixed.

A toner T2 remains on the photoreceptor 2 after transfer, but the thus remaining toner T2 is removed from the photoreceptor 2 by the cleaning device 8.

In the interior of the cleaning device 8, a supporting frame body 801 as a backing member which is long in the rotational axis direction is disposed parallel to the rotational axis of the photoreceptor 2 and is free-rotatably backing material by a shaft 802 at both ends in the direction of the rotational axis of the photoreceptor 2. The supporting frame body 801 is fixed by adhering a cleaning blade formed of an elastic plate constituted of urethane rubber to clean the photoreceptor 2 located at its bottom portion. The supporting frame body 801 is provided with a sealing member 804 at both ends of the cleaning blade 803 to prevent leakage of toner from both ends of the cleaning blade 803. Further, a weight 805 as a means to bring into contact is provided at the other end of the supporting frame body 801 to bring the cleaning edge at the top of the cleaning blade 803 against the photoreceptor 2 at a given contact pressure.

A toner receiving roller 806, which is lightly contacted with the photoreceptor 2 and rotates so that its top face moves in the same direction as the photoreceptor 2, is disposed upstream the cleaning blade 803 (in the rotational direction of the photoreceptor 2). A scraper plate 807 is in contact with the toner receiving roller 806 to scrape any toner from the toner receiving roller 806.

A cleaning blade usually employs rubber elastomer and examples of such a material include urethane rubber, silicone rubber, fluorinated rubber, chloroprene rubber, butadiene rubber and the like. Of these, urethane rubber, which superior in abrasion characteristic to other rubbers, is specifically preferable.

Toner T2 which remains on the photoreceptor 2 after transfer is removed by the cleaning blade 803 is removed by the cleaning blade 803 from the photoreceptor 2, conveyed by the toner receiving roller 806 and the scraper plate 807 to the bottom portion and further conveyed by a toner conveying means (not shown in the drawing) to the outside of the cleaning device 8.

The photoreceptor 2 is constituted of a cylindrical conductive substrate 201, a photosensitive layer 202 formed on the circumference surface of the conductive substrate 201, a non-photosensitive layer forming portion 203 on both ends of the conductive substrate 201 and a mounting shaft 204 of an electrophotographic image forming apparatus at each end of the photoreceptor.

A forming area of the photosensitive layer 202 may be formed on the overall width of the conductive substrate 201 or may be formed with leaving a non-photosensitive layer forming portion 203 at each end of the conductive substrate 201.

Designation "O" indicates the width of the photosensitive layer in the longitudinal axis direction of the photoreceptor 2 and also indicates the image forming area in which the toner image T1 is formed by development in the developing device 5. The toner image T1 is formed in the image forming area, which is also the area of any remaining toner T2 existing after having transferred the image to recording paper P.

P1 designates the width of the non-photosensitive layer forming portion 203 in the axis direction of the photoreceptor at one end of the conductive substrate 201. P2 designates the width of the non-photosensitive layer forming portion 203 at the other end of the conductive substrate 201. The width P1 (or P2) of the non-photosensitive layer forming portion 203 is preferably from 0.5 mm to 20 mm, taking into account prevention of peeling of a photosensitive layer due to contact with a positioning member when installed on an image forming apparatus.

The cleaning blade 803 is mounted on the supporting frame body 801 of the cleaning device 8 so that an edge 803*a* of the cleaning blade 803 is pressed to contact with the overall width "O" of the photosensitive layer 202, enabling it to remove any remaining toner existing on the image forming area. A width (Q) of the cleaning blade 803 is preferably the same as or a little larger than that of the photosensitive layer 202 of the photoreceptor 2.

The sealing member 804 is fixed onto the supporting frame body 801 separately from the cleaning blade 803 to be in contact with the non-photosensitive layer forming portion 203 at each end of the photoreceptor 2. Preferably, the width R1 (or R2) of the sealing member 804 is so wide that an end on the cleaning blade (803) side of the sealing member 804 is in contact with the end of the cleaning blade 803 and is the same as a width P1 (or P2) of the non-photosensitive layer forming portion 203. When removing any toner remaining in an image area by the cleaning blade 803, providing the sealing member 404 at each end of the cleaning blade 803 enables it to prevent leakage of any remaining toner from each end of the cleaning blade 803.

The sealing member is not specifically limited but examples thereof include one in which a porous elastic member, [e.g., Moltplain (trade name), felt, gigging blanket and the like] adhered onto an elastic substrate (e.g., polyethylene terephthalate or PET).

The photoreceptor 2 is provided with at least a photosensitive layer on a conductive substrate and the layer arrangement is not specifically limited. Specific examples of a latter arrangement are as follows:

1) A layer arrangement of a conductive substrate provided thereon with a charge generation layer, a charge transport layer and a protective layer in the said sequence;

2) A layer arrangement of a conductive substrate provided thereon with a single layer containing a charge generation material and a charge transport material and a protective layer in the said sequence;

3) A layer arrangement of a conductive substrate provided thereon with an intermediate layer, a photosensitive layer of a charge generation layer and a charge transport layer and a protective layer in the said sequence;

4) A layer arrangement of a conductive substrate provided thereon with an intermediate layer, a photosensitive layer containing a charge generation material and a charge transport material, and a protective layer in the said sequence.

The photoreceptor of the invention may be any one of the foregoing layer arrangement, and of these is preferred a layer arrangement of a conductive substrate provided with an intermediate layer, a charge generation layer, a charge transport layer, and a protective layer.

The present invention relates to a method of abrading the surface of a photosensitive layer of a photoreceptor, in which, when abrading the photosensitive layer surface of the photoreceptor by using an abrasive tape having a solid body on a backing material, no streak-like flaw caused by the solid body is produced on the photoreceptor surface, any precise control is not required and only the surface of the photosensitive layer is stably abraded.

Figure 2A:
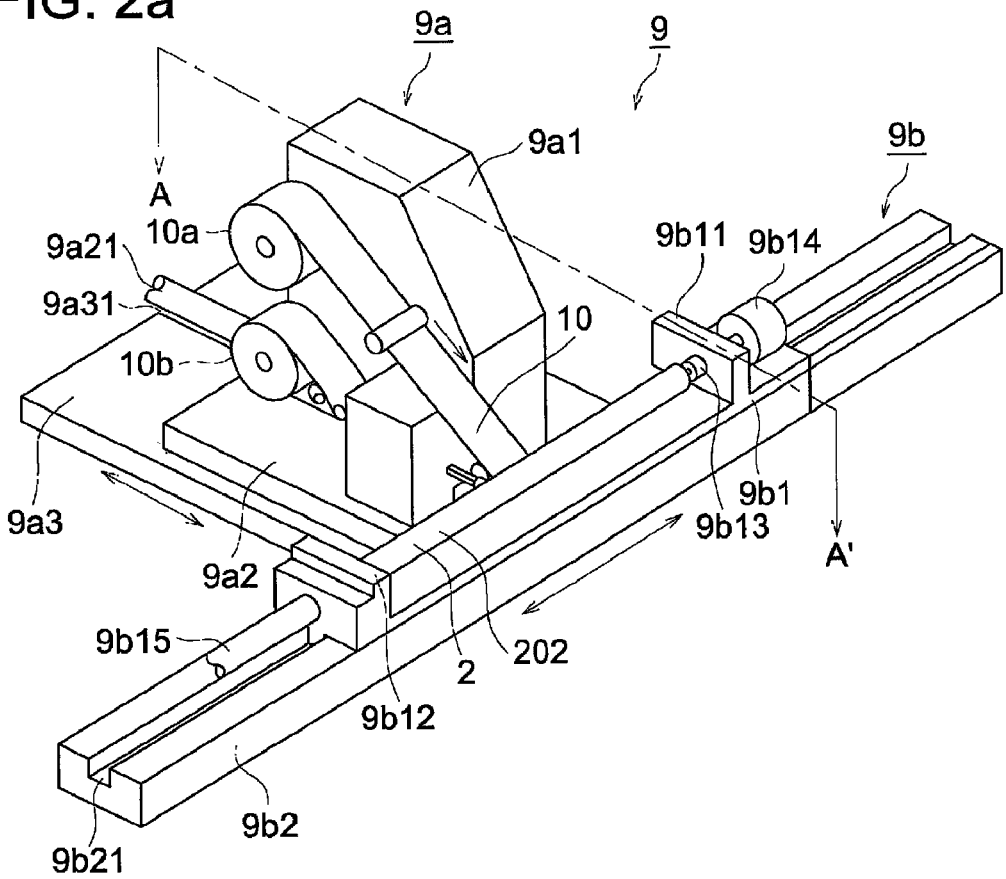
FIGS. 2*a*-2*b* illustrate schematic views of an abrading apparatus to abrade the surface of a photosensitive layer of a photoreceptor.
Figure 2B:
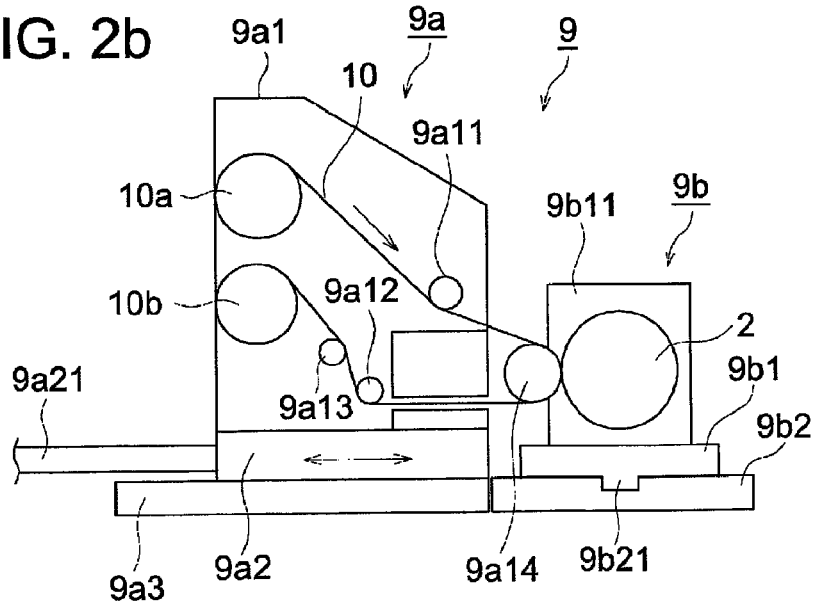

FIGS. 2*a* and 2*b* show a schematic view of an abrading apparatus to abrade the surface of a photosensitive layer of a photoreceptor. FIG. 2*a* shows a perspective view of an abrading apparatus to abrade the photosensitive layer surface of a photoreceptor. FIG. 2*b* shows a sectional view along A-A' of FIG. 2*a*. FIGS. 2*a* and 2*b* show the case of using a belt-form abrasive tape as an abrasive material.

In the drawings, numeral 9 designates an abrading apparatus. The abrading apparatus 9 is provided with an abrasive tape-conveying device 9*a* and a photoreceptor holding device 9*b*. The abrasive tape-conveying device 9*a* comprises a body 9*a*1, a backing material 9*a*2 and base 9*a*3. The body 9*a*1 is provided with a device of a feeding device (not shown in the drawing) of an abrasive tape 10, a take-up reel device (not shown in the drawing) and a tension control device (not shown in the drawing) of the abrasive tape 10. A driving section is provided on the side of the reel device. The tension control device is provided on the side of the feeding device.

Numeral 10*a* designates a roll-formed abrasive tape set in the feeding device. Numeral 10*b* designates a used abrasive tape reeled by the reel device. Numerals 9*a*11-9*a*13 designate guide rolls. The guide rolls 9*a*11 and 9*a*13 are preferably disposed in the body 9*a*1 to control the tension of the abrasive tape 10. Numeral 9*a*14 designates a backup roll. The abrasive tape 10, fed by the feeding device, is taken up to a roll by the reel device via the backup roll 9*a*14. When abrading the surface of the photoreceptor at one position of the abrasive tape 10, abrasion or clogging of the abrasive tape surface often renders it difficult to perform stable abrasion, so that it is preferred to feed an abrasive tape from the feeding device as needed and to take up by the reel device to renew the abrasion surface.

The width of the backup roll 9*a*14 is preferably from 40 to 97% of the width of the photosensitive layer 202, taking into account cutting or the like of the conductive substrate 201 (FIG. 1*b*) exposed to the non-photosensitive layer-forming portion of the photoreceptor 2.

The hardness of the backup roll 9*a*14 is preferably from 20 to 40°, taking into account pressure, stability and abrasiveness.

Materials used for a backup roll are not specifically limited so long as the required hardness can be achieved, and include, for example, neoprene rubber, silicone rubber urethane, fluorinated rubber and butadiene; of these, the neoprene rubber and silicone rubber are preferred.

The width of the abrasive tape 10 of an abrasive member is preferably from 101% to 130% of that of the backup roll 9*a*14, taking into account crease or abrasiveness of an abrasive tape. The width of the abrasive tape refers to the width perpendicular to the conveyance direction of the abrasive tape. The width of the backup roll refers to the width in the axial direction of the drum portion in which the cross-section orthogonal to the center axis of the backup roll has an identical area.

The body 9*a*1 is fixed to a rack 9*a*2 having a shaft for moving (9*a*21) connected to a moving means (for example, a stepping motor), and the backing material 9*a*2 is movable along a traveling channel 9*a*31 provided on the base 9*a*3 (in the direction designated by the arrow or the Y-axis direction).

Movement of the rack 9*a*2 is adjusted by a moving means so that the surface of the abrasive tape 10 and the surface of the photosensitive layer 202 of the photoreceptor 2 are pressed in parallel with each other, and the pressure at the time of abrading is optimally controlled by the type of abrasive tape, hardness of the photosensitive layer surface of the photoreceptor 2, the abrading extent, and the like.

The photoreceptor holding device 9*b* is provided with a rack 9*b*1 and a base 9*b*2. The backing material 9*b*1 comprises a holding member 9*b*11 provided with a holding means 9*b*13 to hold the photoreceptor 2 and a holding member 9*b*12 provided with a holding means (not shown in the drawing). The photoreceptor holding device 9*b* may be any one which can fix or remove the photoreceptor 2 and is, for example, a three nail chuck. The holding means provided on the holding member 9*b*12 may be the same as the holding means 9*b*13. The photoreceptor can be horizontally held by the holding member 9*b*11 and the holding member 9*b*12.

Numeral 9*b*14 designates a motor provided on the rack 9*b*1 and a rotation shaft of the motor 9*b*14 is connected to the holding means 9*b*13 of the holding member 9*b*11 and the photoreceptor 2 held by holding members can be rotated by operating the motor 9*b*14.

The rotation rate (number of revolutions) can be set according to the type of the abrasive tape 10, pressure of the abrasive tape onto the photoreceptor, the abrasion amount and the like, but is from 10 to 1,000 rpm only as a guide. The conveyance rate can also be set according to the type of the abrasive tape 10, pressure of the abrasive tape onto the photoreceptor, the abrasion amount and the like, but is from 50 to 450 mm/min only as a guide.

Numeral 9*b*15 designates a shaft for movement, connected to a moving means (for example, a stepping motor), which is provided on the opposite side of a rack 4*b*1 provided with a motor 9*b*14. A rack 9*b*1 is movable by a moving means (for example, a stepping motor) along a traveling channel 9*a*31 provided on the base 9*b*2 (in the direction designated by the arrow or X-axis direction).

The moving rate of the backing material 9*b*1 can optimally be set according to the type of the abrasive tape 10, pressure of the abrasive tape onto the photoreceptor, an abrasion amount and the like, but is from 10 to 50 mm/min only as a guide. Further, the moving amount can optimally be controlled according to the width of the abrasion area of the photosensitive layer 202 parallel to the shaft of the photoreceptor 2.

The notching extent to set the depth of a groove which is formed by abrasion on the surface of the photosensitive layer 202 or the photoreceptor is set to be preferably from 1.0 to 0.7 mm, and more preferably from 0.2 to 0.7 mm, taking into account holding property of an external additive or a lubricant supplied from the toner at the initial stage after starting image formation, streak defects on the image and cleaning property.

In FIGS. 2*a* and 2*b*, the abrading apparatus 9 shows the case in which the abrasive tape-conveying device 9*a* and the photoreceptor holding device 9*b* orthogonally move in the direction of the Y-axis and the X-axis, respectively. Alternatively, the abrasive tape-conveying device 9*a* and the photoreceptor holding device 9*b* orthogonally move in the direction of the X-axis and the Y-axis, respectively.

In the abrading apparatus 9, the photosensitive layer surface can be abraded by moving an abrading member on a backup roll parallel to the rotation axis of the electrophotographic photoreceptor, while pressing the abrading member against the photosensitive layer surface and also by feeding the abrading member.

Figure 3A:
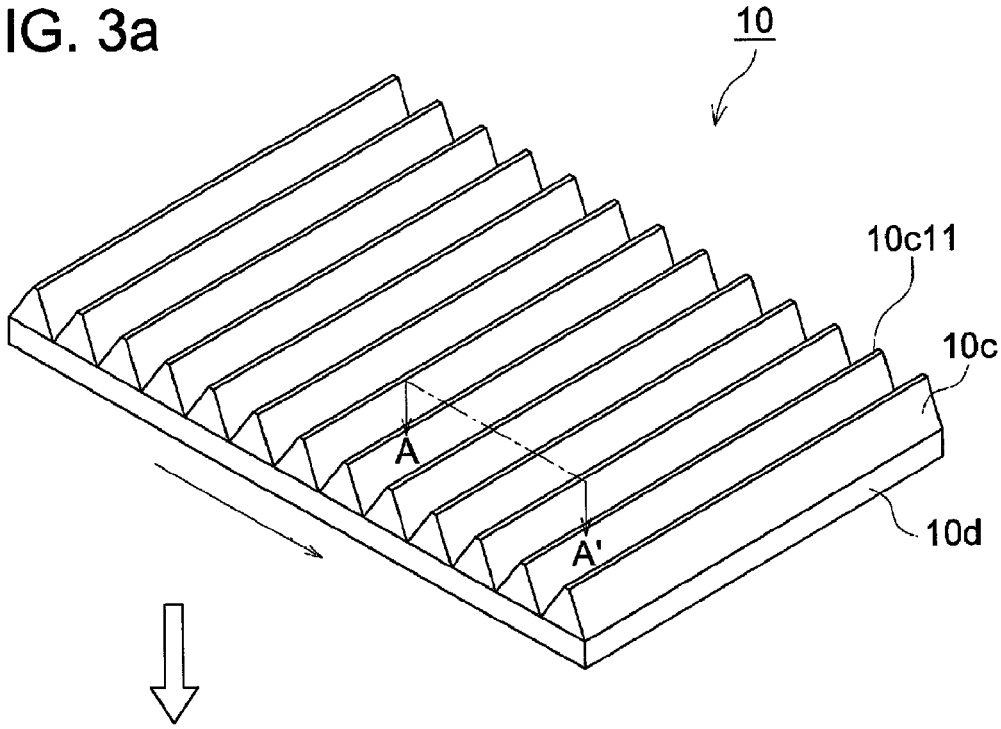
FIGS. 3*a*-3*c* illustrate enlarged schematic views showing the shape of the abrading surface of an abrading tape used the abrading apparatus shown in FIGS. 2*a*-2*b*.
Figure 3B:
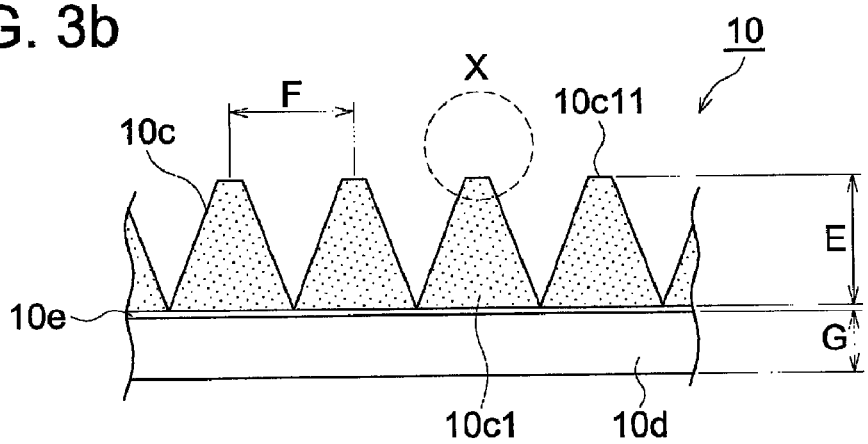
Figure 3C:
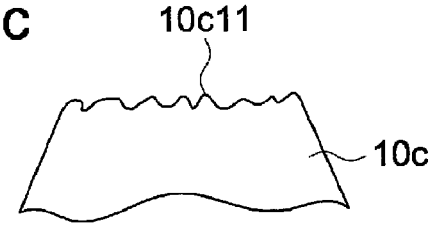

FIGS. 3*a*-3*c* illustrate enlarged view showing the abrasive surface of the abrasive tape used in the abrading apparatus shown in FIGS. 2*a*-2*b*. FIG. 3*a* is an enlarged schematic view of the abrasive surface of the abrasive tape used in the abrading apparatus shown in FIGS. 2*a*-2*b*. FIG. 3*b* is a schematic sectional view along A-A' of FIG. 3*a*. FIG. 3*c* is an enlarged schematic view of the portion designated by X in FIG. 3*b*.

In the figures, the numeral 10 represents an abrasive tape as an abrading member. The numeral 10*c* represents a solid body with a 3-dimensional form, which is provided on a backing material 10*d* and exhibits a triangular sectional form. The solid body 10*c* is formed of a binder resin containing abrasive grains 10*c*1. The numeral 10*c*11 indicates the top face of the solid body and the top face is in contact with the photosensitive layer surface of a photoreceptor. The solid body 10*c* is a continuous form in the width direction of the backing material 10*d*. A concave portion is formed between solid bodies (10*c*) and a convex portion is formed on the top face 10*c*11, whereby the abrading surface of the abrasive tape forms a concave-convex surface. The width direction of the backing material 10*d* refers to the direction vertical to the conveyance direction (as indicated by an arrow) of the abrasive tape 10.

When abrading the photosensitive layer surface of the photoreceptor 2 by using the abrasive tape 10 in the abrading apparatus (as shown in FIGS. 2*a*-2*b*), the top face 10*c*11 is pressed so that it is brought into contact with the photosensitive layer surface parallel to the axis of the photoreceptor 2.

The top face 10*c*11 allows the contact area of a solid body containing abrasive grains of an abrasive tape with the photosensitive layer surface to increase, whereby concentration of pressure to the top of the solid body containing abrasive grains is dispersed, enabling to prevent occurrence of streak-like flaws.

A surface roughness (Ry) of the top face 10*c*11 is from 4.0 to 8.0 μm. A surface roughness (Ry) of less than 4.0 μm is insufficient in abrasiveness of the photoreceptor surface, often causing cleaning troubles. A surface roughness (Ry) of more than 8.0 μm is excessively strong in abrasiveness of the photoreceptor surface, producing streak-like flaws on the image.

The surface roughness (Ry) is a value determined by using a laser microscope (VK-9510, made by KEYENCE Co., Ltd.).

The designation "E" indicates the height from the surface of the backing material 10*d* of the solid body 10*c*. The height (E) is not specifically limited so long as it is at a level which is capable of holding abrasive grains 10*c*1, but is preferably from 10 to 100 μm, taking into account abrasiveness and dropping of abrasive grains.

A height E indicates the value determined by using a laser microscope (VK-9510, made by KEYENCE Co., Ltd.).

A distance F is the length of from the center of the top face to the center of a top face of an adjacent solid body (10*c*). The distance F is preferably from 30 to 100 μm, taking into account clogging of the abrasive tape, due to abrasive residue in abrasion uniformity. A distance F indicates the value determined by using a laser microscope (VK-9510, made by KEYENCE Co., Ltd.).

The designation "G" indicates the thickness of the backing material 10*d*. A thickness G is preferably from 10 to 100 μm, taking into account workability of an abrasive tape and its close contact to the photosensitive layer.

FIGS. 4*a*-4*d* illustrate enlarged schematic views of other shapes of the abrasive surface of abrasive tape used in an abrading apparatus, as shown in FIGS. 2*a*-2*b*.

Figure 4A:
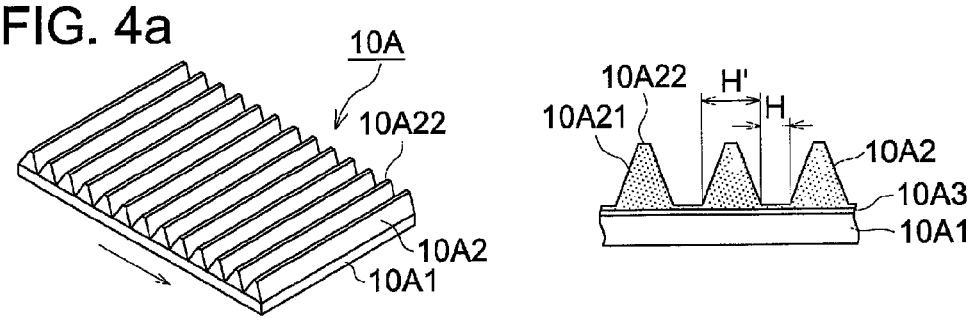
FIGS. 4*a*-4*e* illustrate enlarged schematic views showing other shapes of the abrading surface of an abrading tape used the abrading apparatus shown in FIGS. 2*a*-2*b*.

The abrasive tape, as shown in FIG. 4*a* will now be described. The right side of this drawing shows an enlarged schematic sectional view in a conveyance direction (in the direction indicated by the arrow) of an abrasive tape.

In the drawing, 10A designates an abrasive tape as an abrasive member and 10A2 indicates a solid body with a trapezoidal cross-section, provided on a backing material 10A1. In the abrasive tape 10A, a sheet-form material in which solid bodies (10A2) are continuously connected is provided on the backing material 10A1 through an adhesive layer 10A3. The solid body 10A2 is composed of a binder resin containing abrasive grains (10A21). The designation 10A22 indicates the top face of the solid body 10A2 which is capable of being in contact with the photosensitive layer surface of the photoreceptor. Solid bodies (10A2) are arranged in a continuous form in the width direction of the backing material 10A1, forming a recessed portion between adjacent solid bodies (10A2) and a protruded portion at the top face 10A22 to construct a concave-convex surface for the abrasive surface of an abrasive tape. The width direction of the backing material 10A1 refers to a direction perpendicular to the conveyance direction of the abrasive tape 10A (as indicated by the arrow).

The designation H indicates the distance between base portions on the backing material 10A1 provided thereon with adjacent solid bodies (10A2). The distance H is preferably 10 to 500 μm, taking into account clogging of the abrasive tape, due to abrasive residues and abrasion uniformity. The distance H indicates a value determined by using a laser microscope (VK-9510, made by KEYENCE Co., Ltd.).

The designation H' indicates the width at the position exhibiting a maximum width of the solid body 10A2 in the conveyance direction of the abrasive tape 10A (as indicated by the arrow). The width H' is preferably 30 to 500 μm taking into account strength of the solid body and abrasion uniformity onto the photoreceptor surface. The width H' indicates a value determined by using a laser microscope (VK-9510, made by KEYENCE Co., Ltd.).

The height from the surface of the backing material 10A1 of the solid body 10A2 and the surface roughness (Ry) are the same as in the case of the abrasive tape 10 shown in FIGS. 3*a*-3*c*.

Figure 4B:
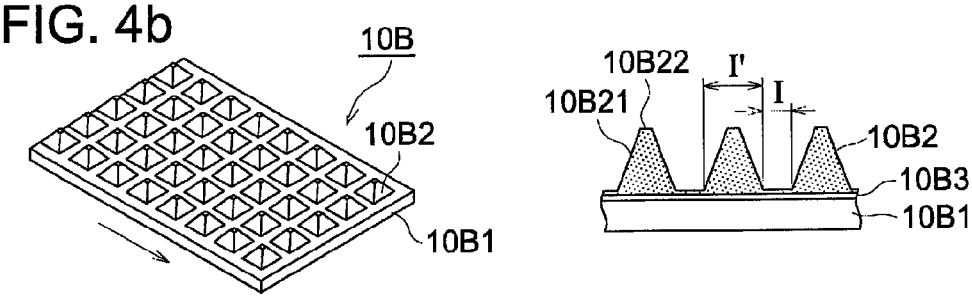

The abrasive tape, as shown in FIG. 4*b* will now be described. The right side of this drawing shows an enlarged schematic sectional view in the conveyance direction (in the direction indicated by the arrow) of the abrasive tape.

In this drawing, 10B designates the abrasive tape as an abrasive member and 10B2 indicates a solid body with a quadrangular pyramid form, provided on a backing material 10B1. In the abrasive tape 10B, a sheet-form material in which solid bodies (10B2) are continuously formed is provided on the backing material 10B1 through an adhesive layer 10A3. The solid body 10B2 is composed of a binder resin containing abrasive grains (10B21). The designation 10B22 indicates the top face of the solid body 10B2 which is capable of being in contact with the photosensitive layer surface of the photoreceptor. Solid bodies (10B2) are arranged in a continuous form in the length direction and in the width direction of the backing material 10B1 at equidistant intervals, forming a recessed portion among adjacent solid bodies (10B2) and a protruded portion at the top face 10B22 to structure a concave-convex surface on the abrasive surface of the abrasive tape. The width direction of the backing material 10B1 refers to the direction perpendicular to the conveyance direction of the abrasive tape 10B (as indicated by the arrow). The length direction of the backing material 10B1 refers to the conveyance direction of the abrasive tape 10B (as indicated by an arrow).

The designation "I" indicates a distance between base portions on the backing material 10B1 provided thereon with adjacent solid bodies (1032). The distance I is the same as H of the abrasive tape 10A shown in FIG. 4A.

The designation I' indicates a width at the position exhibiting a maximum width of the solid body 10B2 in the conveyance direction of the abrasive tape 10B (as indicated by the arrow). The width I' is the same as the width H' of the solid body 10A2 of the abrasive tape 10A shown FIG. 4*a*.

The height from the surface of the backing material 10B1 of the solid body 10B2 and the surface roughness (Ry) of the top surface 10B22 are the same as in the case of the abrasive tape 10 shown in FIGS. 3*a*-3*c*.

The abrasive tape shown in FIG. 4*c* will be described. The right side of this drawing shows an enlarged schematic sectional view in the conveyance direction (in the direction indicated by the arrow) of the abrasive tape.

In this drawing, 10C designates the abrasive tape as an abrasive member and 10C2 indicates a solid body with a rectangular cross-section, provided on a backing material 10A1. In the abrasive tape 10C, a sheet-form material in which solid bodies (10C2) are continuously connected is provided on the backing material 10C1 through an adhesive layer 10C3. The solid body 10C2 is composed of a binder resin containing abrasive grains (10C21). The designation 10C22 indicates the top face of the solid body 10C2 which is capable of being in contact with the photosensitive layer surface of the photoreceptor. Solid bodies (10C2) are arranged in a continuous form in the width direction of the backing material 10C1, forming a recessed portion between adjacent solid bodies (10C2) and a protruding portion of a top face 10C22 to structure a concave-convex surface on the abrasive surfaces of the abrasive tape. The width direction of the backing material 10C1 refers to the direction perpendicular to the conveyance direction of the abrasive tape 10C (as indicated by the arrow).

The designation J indicates the distance between base portions on the backing material 10C1 provided thereon with adjacent solid bodies (10C2). The distance I is the same as H of the abrasive tape 10A, as shown in FIG. 4A.

The designation J' indicates the width at the position exhibiting a maximum width of the solid body 10C2 in the conveyance direction of the abrasive tape 10C (as indicated by the arrow). The width J' is the same as the width H' of the solid body 10A2 of the abrasive tape 10A shown FIG. 4*a*.

The height from the surface of the backing material 10C1 of the solid body 10C2 and the surface roughness (Ry) of the top surface 10C22 are the same as in the case of the abrasive tape 10 shown in FIGS. 3*a*-3*c*.

An abrasive tape shown in FIG. 4*d* will now be described. The right side of this drawing shows an enlarged schematic sectional view in a conveyance direction (in the direction indicated by the arrow) of an abrasive tape.

In this drawing, 10D designates an abrasive tape as an abrasive member and 10D2 indicates a solid body with a ellipsoidal section, provided on a backing material 10D1. In the abrasive tape 10D, a sheet-form material in which solid bodies (10D2) are continuously attached is provided on the backing material 10D1 through an adhesive layer 10D3. The solid body 10D2 is composed of a binder resin containing abrasive grains (10D21). The designation 10A22 indicates the top face of the solid body 10D2 which is capable of being in contact with the photosensitive layer surface of the photoreceptor. Solid bodies (10D2) are arranged in a continuous manner in the width direction of the backing material 10D1, forming a recessed portion between adjacent solid bodies (10D2) and a protruded portion at the top face 10D22 to structure a concave-convex surface on the abrasive surface of the abrasive tape. The width direction of the backing material 10D1 refers to a direction perpendicular to the conveyance direction of the abrasive tape 10D (as indicated by the arrow).

The designation K indicates the distance between base portions on the backing material 10D1 provided thereon with adjacent solid bodies (10D2). The distance K is the same as H of the abrasive tape 10A, as shown in FIG. 4A.

The designation K' indicates the width at the position exhibiting a maximum width of the solid bodies 10D2 in the conveyance direction of the abrasive tape 10D (as indicated by the arrow). The width K' is the same as the width H' of the solid body 10A2 of the abrasive tape 10A shown in FIG. 4*a*.

The height from the surface of the backing material 10D1 of the solid body 10D2 and the surface roughness (Ry) of the top surface 10C22 are the same as in the case of the abrasive tape 10 shown in FIGS. 3*a*-3*c*.

The abrasive tape shown in FIG. 4*e* will now be described. The right side of this drawing shows an enlarged schematic sectional view in the conveyance direction (in the direction indicated by the arrow) of the abrasive tape.

In this drawing, 10E designates an abrasive tape as an abrasive member and 10E2 indicates a solid body with a spindle form, provided on a backing material 10E1. In the abrasive tape 10E, a sheet-form material in which solid bodies (10E2) are continuously connected is provided on the backing material 10E1 through an adhesive layer 10E3. The solid body 10E2 is composed of a binder resin containing abrasive grains (10E21). The designation 10E22 indicates the top face of the solid body 10E2 which is capable of being in contact with the photosensitive layer surface of a photoreceptor. Solid bodies (10E2) are arranged in a continuous manner in the length direction and in the width direction of the backing material 10B1 at equidistant intervals, forming a recessed portion between adjacent solid bodies (10E2) and a protruding portion at the top face 10E22 to structure a concave-convex surface on the abrasive surface of the abrasive tape. The width direction of the backing material 10E1 refers to the direction perpendicular to the conveyance direction of the abrasive tape 10E (as indicated by the arrow). The length direction of the backing material 10E1 refers to the conveyance direction of the abrasive tape 10E (as indicated by the arrow).

The designation K indicates the distance between base portions on the backing material 10E1 provided thereon with adjacent solid bodies (10E2). The distance L is the same as H of the abrasive tape 10A, as shown in FIG. 4A.

The designation L' indicates the width at the position exhibiting a maximum width of the solid body 10E2 in the conveyance direction on the abrasive tape 10E (as indicated by the arrow). The width L' is the same as the width H' of the solid body 10A2 of the abrasive tape 10A shown FIG. 4*a*.

The height from the surface of the backing material 10E1 under the solid body 10E2 and the surface roughness (Ry) of the top surface 10E22 are the same as in the case of the abrasive tape 10 shown in FIGS. 3*a*-3*c*.

The thickness of the backing material of abrasive tapes shown in FIGS. 4*a*-4*e* is the same as that of the backing material 10 of the abrasive tape 10 shown in FIGS. 3*a*-3*c*.

The form of the abrasive surface used in the invention is not limited to the form shown in FIGS. 3*a*-3*c* and FIGS. 4*a*-4*e* but a form of the convex portion (or protruded portion) may be any one which has a concave-convex structure formed by solid bodies on the backing material.

The amount of abrasive grains contained in the solid body of the abrasive tape, as shown in FIGS. 3*a*-3*c* and FIGS. 4*a*-4*e* is preferably from 5 to 80% by mass, based on the solid body, taking into account abrasiveness and dropping of abrasive grains.

The average grain size of the abrasive grains is preferably from 0.01 to 50 μm. The average grain size of abrasive grains is, for example, that obtained by a median diameter (D50) determined in a centrifugal sedimentation method or the like.

Using an abrasive member having an abrasive surface with a form, as shown in FIGS. 3*a*-3*c* and FIGS. 4*a*-4*e*, minute channels can be formed by pressing a continuous- or discontinuous-form convex portions onto the surface of a photosensitive layer of the photoreceptor. Further, using an abrading apparatus (9) shown in FIGS. 2*a*-2*b*, abrasion can be stably performed without forming abrasion streaks, while moving the abrasive tape as an abrasive member and the photoreceptor relatively in parallel with pressing the abrasive tape onto the photosensitive layer surface of the photoreceptor and rotating the photoreceptor. Since abrasion cannot be stably performed due to wearing or clogging of the abrading surface of the abrasive tape, it is preferred that an abrasive tape is appropriately fed from a feeder (not shown in the drawing) and is taken up by a reeling device (not shown in the drawing) to renew the abrading surface.

An external additive or a lubricant which is supplied from the toner at the time of image formation is held in grooves on the surface of the photosensitive layer which are formed by the abrading face formed of solid bodies and the overall surface of the photosensitive layer is activated by the action of such an external additive or a lubricant, whereby adhesion of the toner or the like can be inhibited.

An abrasive member having an abrasive face, as shown in FIGS. 3*a*-3*c* and FIGS. 4*a*-4*e* can be produced according to the steps, as described below.

Step 1: Using a female mold fitted to the solid body of the abrasive member, a film mold is prepared by heat-molding.

Step 2: An abrasive grain-dispersed binder resin is cast into the film mold and is solidified by evaporating a solvent.

Step 3: An adhesive is then coated on a backing material.

Step 4: The film mold having an abrasive grain-dispersed binder resin and was solidified is adhered to the adhesive-coated surface with the convex portion upward. Thereafter, the film mold is strongly adhered to the backing material by a hardening means fitted to the adhesive (for example, a heating treatment, ultraviolet ray exposure, or the like).

Step 5: After being subjected to a heating treatment to harden the binder resin, the film mold is peeled away. An abrasive tape containing abrasive grains and exhibiting a three-dimensional form is prepared in this step.

Step 6: A grinding treatment is performed so that a surface roughness (Ry) of a top face of such a three-dimensional form is adjusted to a prescribed roughness. Such a grinding treatment is not specifically limited and examples thereof include sand blasting, laser exposure and a technique of being in contact with an abrading member, which is appropriately chosen.

Step 7: After grinding an abrasive tape, cleaning is conducted to remove grinding residue clogged between solid bodies or onto the top face of a solid body, according to the following procedure.

Procedure 1: An abrasive tape is immersed in an immersion bath of deionized water containing a 0.1-5% surfactant (approximately 1 μS/cm) for 10 to 30 min. As a surfactant is employed a neutral detergent (pH=6-8), an anionic surfactant (e.g., alkyl ether sulfuric acid ester sodium salt or the like) or a nonionic surfactant (e.g., alkyl polyglicoside or the like).

Procedure 2: After completing immersion, washing is conducted in the immersion bath. The washing method is not specifically limited and examples thereof include ultrasonic washing, bubble washing, nozzle washing and brush washing.

(1) Ultrasonic Washing:

Examples of conditions include an ultrasonic power of 200 to 2000 W, a frequency of 60 to 90 kHz, a temperature of 15 to 40° C. and a washing time of 10 to 180 sec.

(2) Bubble Washing:

Examples of conditions include a bubble size of 3 to 100 μm, a flow pressure of $30\times10^4$ to $100\times10^4$ Pa, an air amount of 0.3 to 5 l/min, a circulation flow rate of 5 to 50 l/min, a washing temperature of 15 to 40° C. and a washing time of 60 to 300 sec.

(3) Nozzle Washing:

Examples of conditions include a pressure of $100\times10^4$ to $800\times10^4$ Pa, a water amount of 3 to 20 l/min, a washing temperature of 15 to 40° C. and a washing time of 60 to 300 sec.

(4) Brush Washing:

Examples of conditions include washing by use of a brush of a nylon, polypropylene or polyester with a line diameter (ϕ) of 0.075 to 1.5 mm and a fiber length of 5 to 20 mm at a washing temperature of 15 to 40° C. for 60 to 300 sec.

An abrasive tape, as shown in FIGS. 3*a*-3*c* and FIGS. 4*a*-4*e* is prepared through steps 1 to 7.

The abrasive tape of an abrasive member with an abrasive surface having a shape, as shown in FIGS. 3*a*-3*c* and FIGS. 4*a*-4*e* is preferably from 40% to 97% of the width of a backup roll, taking into account cutting of an exposed conductive backing material.

Figure 5:
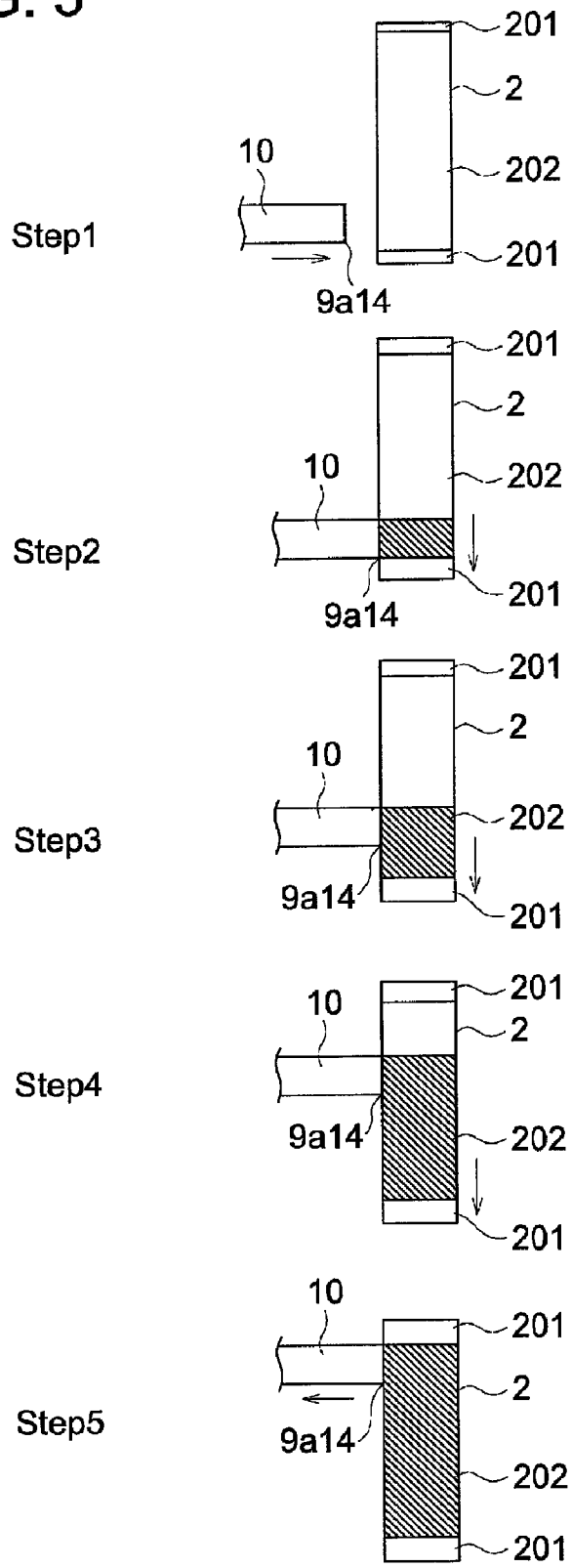
FIG. 5 illustrates a schematic flow showing the steps of abrading the surface of a photosensitive layer of a photoreceptor by using an abrading apparatus, as shown in FIGS. 2*a*-2*b*.

FIG. 5 shows a schematic flow showing steps of abrading the surface of a photosensitive layer of a photoreceptor by using an abrading apparatus shown in FIGS. 2*a*-2*b*, in which an abrasive tape, as shown in FIGS. 3*a*-3*c* is used.

In Step 1, an abrasive tape 10 is prepared, while applying a required tension to a backup roll 9*a*14 of an abrasive tape conveyance device (9*a*) of an abrading apparatus 9 (as shown in FIGS. 2*a*-2*b*). As shown in FIGS. 2*a*-2*b*, a photoreceptor (2) is held by a photoreceptor holding device (9*b*), a rack of the photoreceptor holding device (9*b*) is moved to fit the abrasive tape 10 to the abrasion-initiating position.

In Step 2, the abrasive tape conveyance device (9*a*) is moved so that the abrasive tape 10 on the backup roll 9*a*14 is in close contact with the surface of the photoreceptor 2 with avoiding a non-photosensitive layer portion 203.

In Step 3, while the abrasive tape 10 is brought into close contact with the surface of the photoreceptor 2, the abrasive tape conveyance device (9*a*) is moved toward the photoreceptor 2 and pressed to be in close contact to the surface of the photoreceptor 2. When being pressed, since the hardness of the backup roll 9*a*14 is lower than that of the photosensitive layer, the abrasive tape 10 is apparently in a state of sinking down on the photosensitive layer surface and then, abrasion is started.

The rack of the photoreceptor holding device (9*b*) is moved in the direction designated by the arrow, while rotating the photoreceptor 2 to vary the abrasion position of the photosensitive layer 202. The portion designated by oblique lines indicates an abraded area. The rotation rate is appropriately controlled according to the moving speed of the photoreceptor 2, kind of the abrasive tape, the pressure on the abrasive tape 10 against the photosensitive layer 202 and the extent of the abrasion.

In Step 4, the abrasive tape 10 is brought into close pressure contact with the surface of the photosensitive layer 202, while being pressed thereto, the rack of the photoreceptor holding device (9*b*) is moved, whereby the abrasion position of the photosensitive layer 202 is varied from the position of Step 2. A portion designated by oblique lines indicates the abraded area.

In Step 5, the rack of the photoreceptor holding device (9*b*) is moved to the edge of the photosensitive layer 202, while the abrasive tape 10 is brought into close contact with the surface of the photosensitive layer 202 with rotating the photoreceptor 2. After completing abrasion to the required extent, the abrasive tape conveyance device (9*a*) is moved so that the abrasive tape 10 on the backup roll 9*a*14 is released from close contact against the surface of the photosensitive layer 202, whereby abrasion is completed. As shown in FIG. 6, a photoreceptor is produced in which only the surface of the photosensitive layer 202 is abraded without cutting non-photosensitive layer forming portions 203 at both edges of the photoreceptor; in the drawing, the portion designated by oblique lines indicates an abraded area. After completing abrasion, abrasion wastes attached to the abraded surface are cleaned away for example, by air-blasting).

The steps of 1 to 5 are a surface abrasion method of a photosensitive layer of a photoreceptor to perform stable abrasion of only the photosensitive layer surface of the photoreceptor without forming streak-like flaws on the photosensitive layer surface and also without cutting an exposed portion of then electrically conductive substrate in non-photosensitive layer portions at both edges. To prevent clogging of the abrasive surface of the abrasive tape in the process of from Step 1 to Step 5, it is necessary to feed the abrasive tape to allow the abrasive surface to be always renewed.

Figure 6A:
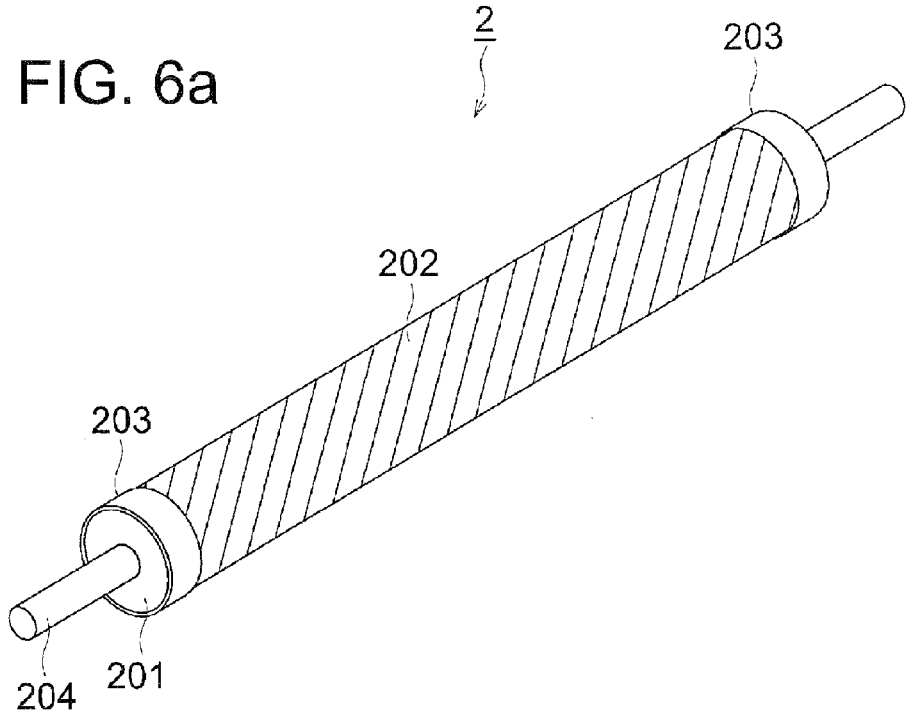
FIGS. 6*a*-6*b* illustrate a photoreceptor produced by an apparatus, as shown in FIGS. 2*a*-2*b*.
Figure 6B:
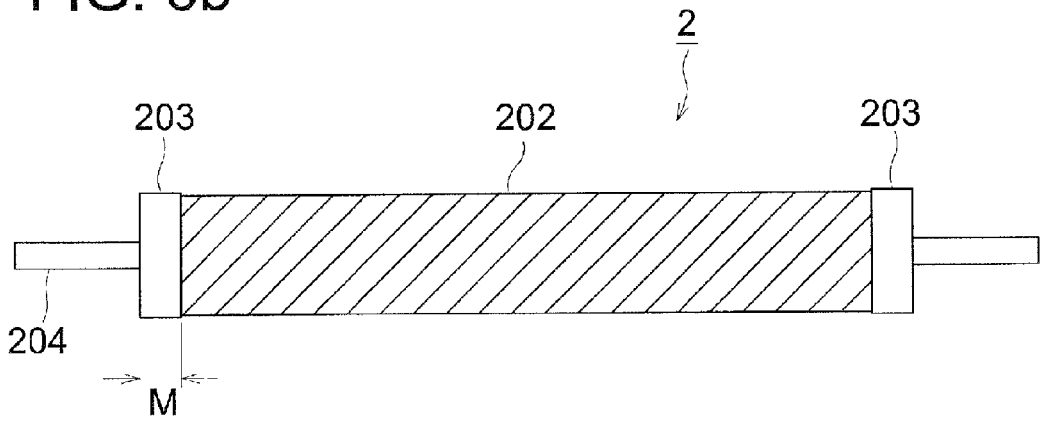

FIGS. 6*a*-6*b* shows a schematic view of a photoreceptor produced by a production apparatus, as shown in FIGS. 2*a*-2*b*.

In the drawing, numeral 204 designates a supporting shaft which is provided at one end of an electrically conductive substrate so that a photoreceptor 2 is rotatable in an electrophotographic image forming apparatus. An identical shaft is provided at the other end. The designation M indicates the width of the non-photosensitive layer forming portion in the axial direction of the photoreceptor. The width M is preferably from 0.5 to 20 mm, taking into account prevention of stripping of a photosensitive layer due to contact with the positioning member when installed to an image forming apparatus. The portion designated by oblique lines indicates the abraded area.

As shown in FIGS. 1-6, while rotating the photoreceptor provided with the photosensitive layer on an electrically conductive substrate, an abrasive member which is narrower than the width of the photosensitive layer entrained about a backup roll and broader than the width of the backup roll, and the photoreceptor is allowed to move parallel to the axial direction, and the abrasive member having an abrasive face with solid bodies, as shown in FIGS. 3*a*-3*c*, is brought into contact with the photosensitive layer surface with feeding the abrading member to abrade the photosensitive layer, whereby the following advantageous effects are achieved as follows:

1. Clogging of an abrasive member due to abrasion residues is inhibited, rendering it feasible to perform stable abrasion;

2. Prevention of occurrence of streak-like flaws becomes possible, also rendering it feasible to perform stable abrasion; and 3. Even in a photoreceptor having a non-photosensitive layer portion on both ends, the electrically conductive substrate is not cut, rendering it feasible to obtain a photoreceptor achieving stable performance.

There will now be specifically described the constitution of an abrasive tape as an abrasive member.

Backing Material of Abrasive Tape

A backing support usable in the invention may be any one which can achieve secure adhesion to a binder resin to form a solid body containing adhesive grains and also exhibit flexibility, and flexible members known in the art, typified by resin film are usable. Specifically, sheet-moldable resin materials known in the art are cited and examples thereof include a polyester resin such as polyethylene terephthalate, a polyamide resin such as nylon film, a cellulose resin such triacetate cellulose film, a polyurethane resin and an epoxy resin. Of these, the polyethylene terephthalate film is specifically preferred, various kinds of which are commercially readily available and can be chosen.

Abrasive Grain

Abrasive grains, which are contained in an abrasive tape of a solid body, essentially perform abrasion of the surface of the photosensitive layer of a photoreceptor. Any abrasive grains which can form groves capable of holding an external additive or a lubricant in an amount not causing an image trouble the initial stage of image formation are usable and are not limited with respect to material quality, grain size or form.

Specific examples of a material usable as an abrasive grain include aluminum oxide, diamond, chromium oxide, silicon carbide, iron oxide, cerium oxide, corundum, silicon nitride, molybdenum carbide, tungsten carbide and silicon oxide. Of these, diamond is preferred.

Binder Resin

Any resin in which abrasive grains can be uniformly dispersed may be used for a binder resin and is not specifically limited, and there are usable a thermoplastic resin, thermosetting resin, a reaction type resin, an electron beam-curable resin, an ultraviolet ray-curable resin, a visible light-curable resin and the like. Examples of a thermoplastic resin include a vinyl resin such as an acryl resin or styrene-butadiene copolymer resin; and a condensation type resin such as a polyamide resin, polyester resin, polycarbonate resin, polyurethane elastomer resin, or polyamide-silicone resin. Examples of a thermosetting resin include a phenol resin, phenoxy-resin, polyurethane resin, polyester resin, silicone resin, melamine resin and alkyd resin.

Adhesive

To achieve strong adhesion between a backing material and the binder resin is cited a ultraviolet ray-curable adhesive known in the art, such as polyethylene-acrylic acid copolymer.

In the following, there will be described a specific structure of a photoreceptor which is preferably usable in the invention.

Conductive Support

An electrically conductive support usable in the invention preferably is a belt-form or cylindrical support, of which a cylindrical support is preferred in term of easiness in designation of an image forming apparatus. A cylindrical conductive support refers to a support of a cylindrical form capable of performing endless image formation and its cylindricity is preferably from 5 to 40 μm, and more preferably from 7 to 30 μm.

Specific examples of a conductive support include a metal drum of aluminum or nickel, a plastic drum on which aluminum, tin oxide, indium oxide or the like is deposited, and a paper or plastic drum coated with an electrically conductive material. The specific resistivity of a conductive support is preferably not more than $10^3$ Ωcm.

Examples of a substrate used for a belt-form photoreceptor include a polyimide resin, a polyester resin or a polycarbonate resin on the surface of which aluminum is deposited or indium/tin oxide is formed.

Intermediate Layer

An intermediate layer is formed by coating, on a conductive support, a coating solution containing a binder, a dispersing solvent and the like, followed by being dried. Examples of a binder used for an intermediate layer include a polyamide resin, vinyl chloride resin, a vinyl acetate resin and a copolymeric resin containing at least two repeating units of the foregoing resins. Of these resins is preferred a polyamide resin which is capable of inhibiting an increase of residual potential. A filler such as titanium oxide or zinc oxide or an antioxidant may appropriately be incorporated in an intermediate layer to achieve enhanced potential characteristics or reduction in black spot defect or the moire effect.

A solvent used for preparation of an intermediate layer coating solution is preferably one which is capable of dispersing appropriately added inorganic particles and dissolving a polyamide resin. Specifically, alcohols having 2-4 carbon atoms, such as methanol, ethanol, n-propyl alcohol, iso-propyl alcohol, n-butanol, t-butanol and sec-butanol are preferred. These solvents are contained preferably in an amount of 30 to 100%, more preferably 40 to 100% and still more preferably 50 to 100% of total solvents. The foregoing solvents may be used in combination with an auxiliary solvent. Examples of such an auxiliary solvent include benzyl alcohol, methylene chloride, cyclohexane, tetrahydrofuran and the like. The thickness of an intermediate layer is preferably from 0.2 to 40 μm, and more preferably from 0.3 to 20 μm.

Photosensitive Layer

A photosensitive layer may be a single layer structure to allow a charge generation function and a charge transport function to exist in one layer, but preferably has a layer structure in which functions of the photosensitive layer are separated, as a charge generation layer (CGL) and a charge transport layer (CTL). Such a function separation structure can reduce an increase of residual potential along with repeated use and easily controls other electrophotographic characteristics according to the purpose thereof. A negative-charged photoreceptor has a structure composed of an intermediate layer provided thereon with a charge generation layer (CGL) and further thereon with a charge transport layer (CTM). A positive-charged photoreceptor has an opposite layer structure to the foregoing negative-charged photoreceptor. Of these layer structures of a photoreceptor is preferred a negative-charged photoreceptor having the function-separating structure described above.

There will be described the individual layers of a photosensitive layer of a function-separated photoreceptor.

Charge Generation Layer (CGL)

A charge generation layer (CGL) contains a charge generation material (CGM) and a binder resin and other additives may be contained therein. Of charge generation materials (CGM) known in the art, those of an oxytitanium phthalocyanine exhibiting a maximum X-ray refraction peak at a Bragg angle (2θ±0.2) of 27.2° and a benzimidazole perylene exhibiting a maximum peak at a Bragg angle of 12.4° exhibit little deterioration and reduced increase of residual potential during repeated use.

When using a binder as a dispersing medium for a charge generation material (CGM) and a charge transfer material (CTM), resins known in the art may be used as a binder. Specific examples of a preferred resin include a polyvinyl formal resin, a polyvinyl butyral resin, a silicone resin, a silicone-modified butyral resin and a phenoxy resin. The ratio of charge generation material (CGM) to binder resin preferably is 20 to 600 parts of a CGM by mass to 100 parts by mass of binder resin. The use of such a resin enables to minimize an increase of residual potential in repeated use. A thickness of a charge generation layer (CGL) is preferably from 0.01 to 2 μm.

Charge Transport Layer (CTL)

A charge transport layer (CTL) contains a charge transport material (CTM) and a binder resin. Other materials may be contained therein as an additive, such as an antioxidant. There are usable charge transport materials (CTM), including, for example, a triphenylamine derivative, a hydrazone compound, a styryl compound, a benzyl compound and a butadiene compound. Such a charge transport material is dissolved in an appropriate solvent to form the layer.

Examples of a resin used for a charge transport layer (CTL) include polystyrene, acryl resin, methacryl resin, vinyl chloride resin, vinyl acetate resin, polyvinyl butyral resin, epoxy resin, phenol resin, polyester resin, alkyl resin, polycarbonate resin, silicone resin, melamine resin and copolymeric resin having at least two repeating units of these resins. In addition to these insulating resins, there may be usable a polymeric organic semiconductor, such as poly-N-vinyl carbazole.

A binder used for a charge transport layer (CTL) preferably is a polycarbonate resin. A polycarbonate resin is preferable for enhancement of dispersibility of a charge transport material (CTM) and electrophotographic characteristics. The ratio of charge transport material (CTM) to binder resin is preferably from 10 to 200 parts by mass of a charge transport material to 100 parts by mass of a binder.

Antioxidant

Application of an antioxidant to a constituent layer of a photoreceptor minimizes effects of actinic gases such as $NO_x$, inhibiting occurrence of image troubles under an environment of high temperature and high humidity.

A typical antioxidant used in the invention is a substance with a property preventing or inhibiting an action of oxygen under light, heat or discharge to an auto-oxidative material existing on the photoreceptor surface, as detailed in the following compounds.

(1) Radical Chain Transfer Inhibitor:

Examples include a phenol type antioxidant, a hindered phenol type antioxidant, an amine type antioxidant, a hindered amine type antioxidant, a diallyldiamine type antioxidant, a diallylamine type antioxidant and a hydroquinone type antioxidant.

(2) Peroxide Decomposable Compound:

Examples include a sulfur antioxidant, thio-ethers, a phosphoric antioxidant and a phosphorous antioxidant.

The hindered phenol type antioxidant (antioxidant having a hindered phenol structure) is a compound having a bulky organic group at an ortho-position to a phenolic OH group or an alkoxylated phenolic OH group, and the hindered amine type antioxidant (an antioxidant having a hindered amine structure) is a compound having a bulky organic group in the vicinity of a N-atoms. A bulky organic group include a branched alkyl group and, for example, is preferably t-butyl group.

Of the foregoing antioxidants, a radical chain transfer inhibitor, as described in (1) are preferred, and of these, an antioxidant having a hindered phenol structure or a hindered amine structure is preferred, which inhibits the reaction of oxygen with radical active species generated from a polymerization initiator and causes the radical active species to effectively contribute to polymerization.

Two or more antioxidants may be used in combination and, for example, a hindered phenol antioxidant (I) and a thioether antioxidant may be used in combination.

In one preferred embodiment of the invention, an antioxidant having the foregoing hindered amine structure in the molecule is effective in enhancement of image quality, such as prevention of image insharpness or black spotting. In another embodiment, an antioxidant having a hindered phenol structure and a hindered amine structure in the molecule is also preferred.

A protective layer is formed by coating a coating solution prepared by addition of inorganic particles to a binder resin on a charge transport layer. The protective layer preferably contains an antioxidant and a lubricant.

There are usable inorganic fine particles such as silica, alumina, strontium titanate, zinc oxide, titanium oxide, tin oxide, antimony oxide, indium oxide, bismuth oxide, tin-doped indium oxide, antimony- or tantalum-doped tin oxide or zirconium oxide. Of these, silica, alumina, titanium oxide or strontium titanate is preferred.

The number average primary particle size of inorganic particles is preferably from 1 nm to 300 nm, and more preferably from 5 nm to 100 nm. The number average primary particle size of inorganic particles is a value obtained in such a manner that 300 particles are randomly chosen and observed with a transmission electron microscope at a 10,000-fold magnification and the number average diameter of the Feret diameter is calculated from the observed values.

A binder resin used for a protective layer may employ any one of a thermoplastic resin and a thermosetting resins. Specific examples thereof include a polyvinyl butyral resin, an epoxy resin, a polyurethane resin, a phenol resin, a polyester resin, an alkyd resin, a polycarbonate resin, a silicone resin, and a melamine resin.

Examples of a lubricant material used for a protective layer include resin fine-powder (e.g., fluororesin, polyolefin resin, silicone resin, melamine resin, urea resin, acrd resin, styrene resin, and the like), metal oxide fine-powder (e.g., titanium oxide, aluminum oxide, tin oxide, and the like), a solid lubricant (e.g., polytetrafluoroethylene, polychlorotrifluoroethylene, polyfluorovinylidene, zinc stearate, aluminum stearate, and the like), silicone oil (e.g., dimethylsilicone oil, methylphenylsilicone oil, methyl hydrogen polysiloxane, cyclic dimethyl polysiloxane, alkyl-modified silicone oil, polyether-modified silicone oil, alcohol-modified silicone oil, fluorine-modified silicone oil, amino-modified silicone oil, mercapto-modified silicone oil, epoxy-modified silicone oil, carboxy-modified silicone oil, higher fatty acid-modified silicone oil, and the like), fluororesin powder (e.g., tetrafluoroethylene resin powder, trifluorochloroethylene resin powder, hexafluoroethylene propylene powder, fluorinated vinyl resin powder, fluorinated vinylidene resin powder, fluoro-dichloro-ethylene resin powder and copolymers of these), polyolefin resin powder (e.g., homo-polymer resin powder such as polyethylene resin powder, polypropylene resin powder and polyhexene resin powder; copolymer resin powder such as ethylene-propylene copolymer and ethylene-butene copolymer; three-dimensional copolymer of these and hexane; and heat-modified polyolefin resin powder). Of these, silicone oil is preferred to achieve enhanced reduction of friction coefficient.

The molecular weight or the individual resin or its powdery particle size may appropriately be chosen. In the case of a particulate material, its particle size is preferably from 0.1 μm. A dispersing agent to allow a lubricant to be homogeneously dispersed may be added to a binder resin. The foregoing lubricant material may be added to a charge transport layer in cases when the charge transport layer is the uppermost layer.

Preparation of Photoreceptor preparation of the individual layers of a photoreceptor (intermediate layer, photosensitive layer, charge generation layer, charge transport layer, protective layer) can be conducted by coating a layer by an immersion coating method, a circular quantity-control coating, or their combination, but is not limited to these. The circular quantity-control coating is detailed in JP 58-189061A.

EXAMPLES

The present invention will be further described with reference to examples but is by no means limited to these. In Examples, "part(s)" represents part(s) by mass, unless otherwise noted.

Example 1

Preparation of Photoreceptor

Preparation of Conductive Substrate:

An electrically conductive aluminum substrate with a 30 mm diameter and a 360 mm length was prepared and the surface of the conductive substrate was subjected to a machining treatment so that the conductive substrate surface exhibited a ten-point mean surface roughness ($R_z$). The ten-point mean surface roughness ($R_z$) is a value determined in accordance with JIS B 0601-2001 or ISO 468-1982

Formation of Intermediate Layer

A dispersion having the following composition was diluted two times with the same solvent mixture as below, allowed to stand over 24 hours. and then filtered with a filter (lysi-mesh 5 μm filter, made by Nippon Pall Co.) to prepare a coating solution of an intermediate layer.

| | |
|---|---|
| Polyamide resin CM 8000 (made by TORAY) | 1 part |
| Titanium oxide SMT 500SAS (made by TAYCA Co.) | 3 parts |
| Methanol | 8 parts |
| 1-Butanol | 2 parts |

Using a sand mill as a dispersing machine, the mixture was batch-wise dispersed over 10 hours to prepare a coating solution. The thus prepared coating solution was coated on the substrate described above by an immersion coating method to form a 2 μm thick dry layer.

Formation of Charge Generation Layer

| | |
|---|---|
| Charge generation material: titanyl phthalocyanine pigment* | 20 parts |
| Polyvinyl butyral resin (#6000-C, made by Denki Kagaku Kogyo Co. Ltd.) | 10 parts |
| t-Butyl acetate | 700 parts |
| 4-methox-4-methyl-2-pentanone | 300 parts |

*titanyl phthalocyanine exhibiting a maximum refraction peak at least at a position of 27.3 ± 0.2° in CU-Kα characteristic X-ray refraction spectrum.

The foregoing composition was dispersed over 10 hours in a sand mill to prepare a coating solution of a charge generation layer. The coating solution was coated on the foregoing intermediate layer by an immersion coating method to form a charge generation layer of a 0.3 μm dry thickness.

Formation of Charge Transport Layer

| | |
|---|---|
| Charge transport material [4,4'-dimethyl-4''-(-phenylstyryl)triphenylamine] | 25 parts |
| Binder: polycarbonate (Z300, made by Mitsubishi Gas Kagaku Co., Ltd.) | 300 parts |
| Antioxidant (Irganox 1010, made by Nippon Chibe-Geigy Co.) | 6 parts |
| THF | 1600 parts |
| Toluene | 400 parts |
| Silicone oil (KF-50, made by Shinetsu Kagaku Co.) | 0.001 parts |

The foregoing composition was dispersed to prepare a coating solution of a charge transport layer. The coating solution was coated on the charge generation layer by an immersion coating method to form a charge transport layer of a 25 μm dry thickness.

Formation of Protective Layer

| | |
|---|---|
| Particulate titanium oxide (SMT 100 SAS, made by TAYCA Co.) | 0.6 parts |
| 2-Propanol | 5 parts |
| Silicone oil (X-22-160AS Made by Shinetsu Kagaku Co.) | 0.002 parts |

The foregoing composition was mixed and dispersed by a Ultrasonic homogenizer over 1 hr. to obtain a dispersion. Then, 1.5 parts of radical-polymerizable compound composed of acryl compounds A and B (mass ratio A/B=1/1) and 0.07 parts of a polymerization initiator (Irgacure 184, made by Chiba Japan Co., Ltd.) were dissolved in the dispersion to prepare a coating solution of a protective layer.

Acryl Compound A

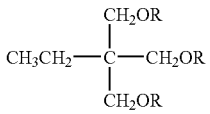

-continued

Acryl Compound B

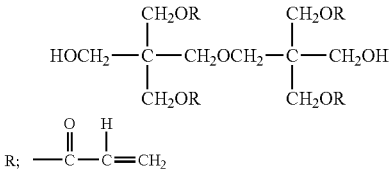

The protective layer coating solution was coated on the overall surface of the charge transport layer by the immersion coating method to form a 2.0 μm thickness after being cured. After coating, a coated layer was exposed to ultraviolet rays using a mercury lamp exposure device (ECS-401GX, made by EYE GRAPHICS CO., LTD.) at an integrated amount of light of 25 J/cm$^2$ in a UV illumination photometer [UVPF-A1 (PD-365), made by EYE GRAPHICS CO., LTD.]. After completion of ultraviolet exposure, the coated layer was thermally dried at 120° C. over 60 min. to form a protective layer. A photosensitive layer formed at both ends was cut to form a 5 mm wide non-photosensitive layer portion on each end side.

An electrophotographic photoreceptor provided with a protective layer containing titanium oxide particles was prepared in accordance with the following procedure.

Preparation of Abrasive Tape

In accordance with the following procedure were prepared abrasive tapes 1-1 to 1-42, in which a surface roughness (Ry) of the top face of a solid body containing abrasive grains was varied as shown in Table 1. The surface roughness (Ry) is a value determined by using a laser microscope (VK-9510, made by KEYENCE Co., Ltd.).

TABLE 1

Figure 4C:
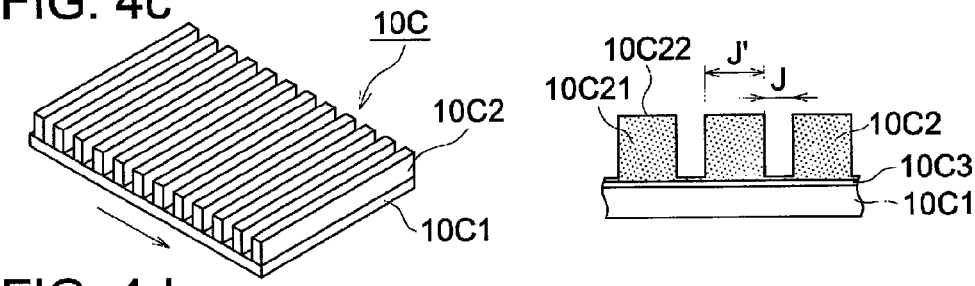
Figure 4D:
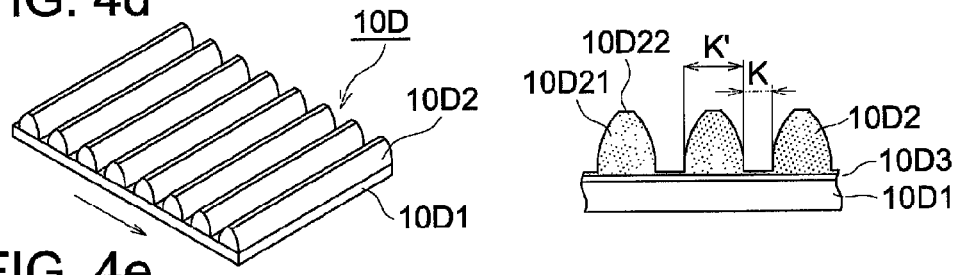

| Abrasive Tape No. | Form Of Solid Body Of Abrasive Tape | Surface Roughness Ry (μm) Of Top Face |
|---|---|---|
| 1-1 | FIGS. 3a-3b | 3.0 |
| 1-2 | FIGS. 3a-3b | 4.0 |
| 1-3 | FIGS. 3a-3b | 5.0 |
| 1-4 | FIGS. 3a-3b | 6.0 |
| 1-5 | FIGS. 3a-3b | 7.0 |
| 1-6 | FIGS. 3a-3b | 8.0 |
| 1-7 | FIGS. 3a-3b | 9.0 |
| 1-8 | FIG. 4a | 3.0 |
| 1-9 | FIG. 4a | 4.0 |
| 1-10 | FIG. 4a | 5.0 |
| 1-11 | FIG. 4a | 6.0 |
| 1-12 | FIG. 4a | 7.0 |
| 1-13 | FIG. 4a | 8.0 |
| 1-14 | FIG. 4a | 9.0 |
| 1-15 | FIG. 4b | 3.0 |
| 1-16 | FIG. 4b | 4.0 |
| 1-17 | FIG. 4b | 5.0 |
| 1-18 | FIG. 4b | 6.0 |
| 1-19 | FIG. 4b | 7.0 |
| 1-20 | FIG. 4b | 8.0 |
| 1-21 | FIG. 4b | 9.0 |
| 1-22 | FIG. 4c | 3.0 |
| 1-23 | FIG. 4c | 4.0 |
| 1-24 | FIG. 4c | 5.0 |
| 1-25 | FIG. 4c | 6.0 |
| 1-26 | FIG. 4c | 7.0 |
| 1-27 | FIG. 4c | 8.0 |
| 1-28 | FIG. 4c | 9.0 |
| 1-29 | FIG. 4d | 3.0 |
| 1-30 | FIG. 4d | 4.0 |
| 1-31 | FIG. 4d | 5.0 |
| 1-32 | FIG. 4d | 6.0 |
| 1-33 | FIG. 4d | 7.0 |
| 1-34 | FIG. 4d | 8.0 |
| 1-35 | FIG. 4d | 9.0 |

TABLE 1-continued

Figure 4E:
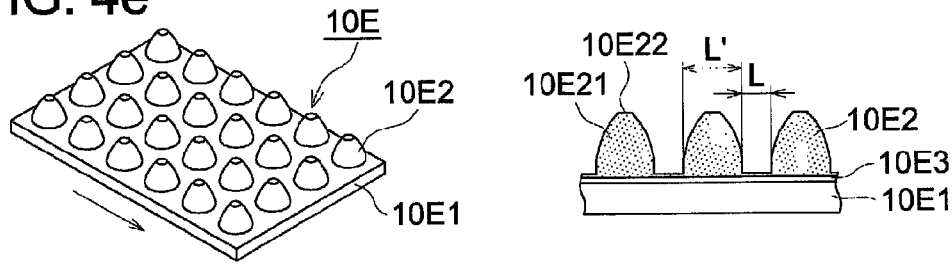

| Abrasive Tape No. | Form Of Solid Body Of Abrasive Tape | Surface Roughness Ry (μm) Of Top Face |
|---|---|---|
| 1-36 | FIG. 4e | 3.0 |
| 1-37 | FIG. 4e | 4.0 |
| 1-38 | FIG. 4e | 5.0 |
| 1-39 | FIG. 4e | 6.0 |
| 1-40 | FIG. 4e | 7.0 |
| 1-41 | FIG. 4e | 8.0 |
| 1-42 | FIG. 4e | 9.0 |

There were prepared abrasive tapes having solid body in accordance with the following procedure.

Preparation of Backing Material of Abrasive Tape:

There was prepared a 100 mm wide, 50 μm thick, 7 mm long polyethylene terephthalate film used for a backing material of an abrasive tape.

Preparation of Solid Body

Preparation of Molding Sheet:

To prepare molds capable of molding a solid body having a steric portion with a height and a distance between centers of top faces, as shown in FIGS. 3*a*-3*b* and FIGS. 4*a*-4*e*, a molding sheet was prepared by using a laser machine for each solid body fitted to the width and length of a backing material of the prepared abrasive tape.

Molding of Steric Form Portion:

A thermosetting phenoxy resin used for a binder resin was dissolved in propylene glycol monomethyl ether to prepare a resin liquid. Further thereto, artificial diamond of an average particle size of 0.5 μm as abrasive grains was added in an amount of 20% by mass and dispersed in the resin liquid. Then, the resin liquid was poured into a mold and the solvent was evaporated to obtain a solid body with a steric form portion, while being molded in a mold.

Pasting:

A UV-curable adhesive of polyethylene-acrylic acid copolymer was coated at a thickness 50 μm on the backing material prepared above, and a solid body was pasted thereto with turning the steric portion upward and exposed to ultraviolet rays to adhere the solid body to the backing material. Subsequently, heating was performed at 90° C. for 20 min. and then, the mold was removed. Further, a heating treatment was conducted over 24 hours. at 110° C. to obtain an abrasive tape with a solid body of a steric form.

Adjustment of Surface Roughness (Ry):

Employing an abrading apparatus shown in FIG. 2*a* and an acryl resin cylindrical pipe as an abraded material, the surface roughness (Ry) of the top face of a solid body was adjusted with varying the rotation rate of the cylindrical tube, the pressure of the abrasive tape onto the surface of the cylindrical tube and time. After completion of abrasion, the abrasive tape was immersed in deionized water containing 1% sodium alkyl ether sulfate (approximately 1 μS/cm) for 15 min.

After completing immersion, the abrasive tape was washed in an immersion bath at an output power of 500 W, a frequency of 75 kHz and 25° C. for 30 sec., whereby the abrasive tape was prepared.

Preparation of Backup Roll:

A backup roll made of neoprene rubber with a hardness of 70%, as shown in FIG. 5 was prepared, the width of which was 70% of the photoreceptor.

Abrasion:

The thus prepared backup roll was loaded onto an abrasive tape conveyance device of the abrading apparatus, as shown FIG. 2*a*. After each of the prepared abrasive tapes No. 1-1 to 1-42 was entrained about the backup roll and a photoreceptor was loaded for a photoreceptor holding device, abrasion of the surface of the photosensitive layer of the photoreceptor was performed under the conditions described below, whereby photoreceptors No. 101 to 142 were prepared.

Rotation rate (circumferential velocity): 400 rpm (0.16 m/sec),

Feeding rate of abrasive tape: 30 mm/min,

Notching extent: 0.5 mm

Moving speed of photoreceptor: 300 mm/min

The rotation rate (circumferential velocity) of the photoreceptor was a value determined in HT-4200, made by ONO SOKKI Co., Ltd. The feeding rate of then abrasive tape is a value obtained by measurement of a length fed during operation for 1 min. The notching extent was a value measured in a micrometer, made by MITSUTOYO Co., Ltd. The moving speed of the photoreceptor is a value obtained by measuring the moving distance for 10 sec. and converting it to 1 min.

Evaluation

Samples 101-142 were each evaluated with respect to occurrence of streak-like flaws and image quality in the following manner and evaluation results based on evaluation ranks described below are shown in Table 2.

Evaluation of Streak-Like Flaw:

Each of the samples was loaded into a modified hybrid machine bizhub C352 (produced by Konica Minolta Business Technologies Inc.) and printing of 500 sheets of A3 size was conducted to form half-tone images with a density of 0.4 (hereinafter, also denoted simply as prints) under ordinary temperature and humidity (20° C., 50% RH). The thus obtained prints were visually observed with respect to the number of streak-like flaws as image quality. Evaluation results are shown in Table 2. Evaluation was made based on the following criteria:

A level of no streak-like flaw being excellent, a level of one streak-like flaw being good, and a level of not less than two streak-like flaw being poor.

Evaluation of Image Quality:

Each of the samples was loaded into a modified hybrid machine bizhub C352 (produced by Konica Minolta Business Technologies Inc.,) and printing of 1000 sheets of A3 size was conducted to form half-tone images with a density of 0.4, a line-image with 5% pixel ratio and an image with 25% pixel ratio (hereinafter, also denoted simply as prints) under ordinary temperature and humidity (20° C., 50% RH). The thus obtained prints were visually observed with respect to the number of white streaks as image quality. Evaluation results are shown in Table 2. Evaluation was made based on the following criteria:

A level of no white streak caused by adhesion of foreign substances being excellent, a level of foreign substances of not less than one and less than five being good, and a level of foreign substances of not less than five being poor.

TABLE 2

| Sample No. | Abrasive Tape No. | Number of Streak-like Flaws | Number of White Streaks | Remark |
|---|---|---|---|---|
| 101 | 1-1 | 4 | 7 | Comp. |
| 102 | 1-2 | 0 | 0 | Inv. |
| 103 | 1-3 | 0 | 1 | Inv. |
| 104 | 1-4 | 0 | 0 | Inv. |
| 105 | 1-5 | 1 | 0 | Inv. |
| 106 | 1-6 | 0 | 0 | Inv. |
| 107 | 1-7 | 6 | 3 | Comp. |
| 108 | 1-8 | 4 | 6 | Comp. |
| 109 | 1-9 | 0 | 1 | Inv. |
| 110 | 1-10 | 0 | 1 | Inv. |

TABLE 2-continued

| Sample No. | Abrasive Tape No. | Number of Streak-like Flaws | Number of White Streaks | Remark |
|---|---|---|---|---|
| 111 | 1-11 | 0 | 0 | Inv. |
| 112 | 1-12 | 0 | 0 | Inv. |
| 113 | 1-13 | 1 | 0 | Inv. |
| 114 | 1-14 | 8 | 4 | Comp. |
| 115 | 1-15 | 3 | 6 | Comp. |
| 116 | 1-16 | 1 | 0 | Inv. |
| 117 | 1-17 | 0 | 0 | Inv. |
| 118 | 1-18 | 0 | 0 | Inv. |
| 119 | 1-19 | 0 | 0 | Inv. |
| 120 | 1-20 | 1 | 0 | Inv. |
| 121 | 1-21 | 6 | 2 | Comp. |
| 122 | 1-22 | 4 | 8 | Comp. |
| 123 | 1-23 | 0 | 2 | Inv. |
| 124 | 1-24 | 0 | 1 | Inv. |
| 125 | 1-25 | 0 | 0 | Inv. |
| 126 | 1-26 | 0 | 0 | Inv. |
| 127 | 1-27 | 1 | 0 | Inv. |
| 128 | 1-28 | 9 | 4 | Comp. |
| 129 | 1-29 | 3 | 8 | Comp. |
| 130 | 1-30 | 1 | 2 | Inv. |
| 131 | 1-31 | 0 | 0 | Inv. |
| 132 | 1-32 | 0 | 0 | Inv. |
| 133 | 1-33 | 0 | 0 | Inv. |
| 134 | 1-34 | 1 | 0 | Inv. |
| 135 | 1-35 | 6 | 4 | Comp. |
| 136 | 1-36 | 3 | 7 | Comp. |
| 137 | 1-37 | 0 | 2 | Inv. |
| 138 | 1-38 | 0 | 0 | Inv. |
| 139 | 1-39 | 0 | 0 | Inv. |
| 140 | 1-40 | 1 | 0 | Inv. |
| 141 | 1-41 | 1 | 0 | Inv. |
| 142 | 1-42 | 8 | 3 | Comp. |

It was shown that Samples 102-106, 109-113, 116-120, 123-127, 130-134 and 137-141, which were each prepared by abrading the photosensitive layer surface of a photoreceptor using abrasive tape Nos. 1-2 to 1-6, 1-9 to 1-13, 1-16 to 1-20, 1-23 to 1-27, 1-30 to 1-34 and 1-37 to 1-41 in which the surface roughness (Ry) of the top face of a solid body was from 4.0 μm to 8.0 μm, caused no streak-like flaw and exhibited superior performance in image quality.

It was shown that Samples 101, 108, 115, 122, 129 and 136, which were each prepared by abrading the photosensitive layer surface of a photoreceptor using abrasive tape Nos. 1-1, 1-8, 1-15, 1-22, 1-29 and 1-36 in which the surface roughness (Ry) of the top face of a solid body was 3.0 μm, exhibited inferior performance in image quality.

It was also shown that Samples 107, 114, 121, 128, 135 and 142, which were each prepared by abrading the photosensitive layer surface of a photoreceptor using abrasive tape Nos. 1-7, 1-14, 1-21, 1-28, 1-35 and 1-42 in which the surface roughness (Ry) of the top face of a solid body was 9.0 μm, exhibited inferior performance in prevention of streak-like flaw.

In view of the foregoing results, effectiveness of the present invention was confirmed.

Example 2

Preparation of Photoreceptor

The photoreceptor was prepared in the same manner as in Example 1.

Preparation of Backup Roll

Silicone rubber backup rolls 2-1 to 2-7 were prepared, in which a width ratio of a backup roll to a photosensitive layer of a photoreceptor was varied, as shown in Table 3.

TABLE 3

| Backup roll No. | Width Ratio (%) Of Backup roll to Photosensitive Layer |
|---|---|
| 2-1 | 2 |
| 2-2 | 3 |
| 2-3 | 8 |
| 2-4 | 15 |
| 2-5 | 40 |
| 2-6 | 60 |
| 2-7 | 70 |

Preparation of Abrasive Member

There were prepared abrasive tapes which were each the same as abrasive tape No. 1-2 and have a width of 110% of the width of the respective backup rolls 2-1 to 2-7.

Abrasion

The thus prepared backup rolls 2-1 to 2-7 and abrasive tapes which were each prepared in combination with the respective backup rolls 2-1 to 2-7, were installed to an abrasive tape conveyance device of an abrading apparatus, as shown in FIG. 2*a*. Then, after loading the photoreceptor to a photoreceptor holding device, abrasion of the surface of a photosensitive layer of a photoreceptor was conducted under the same conditions as in Example 1, whereby photoreceptors were prepared and denoted as Samples 201 to 207.

Evaluation

The thus prepared samples 201-207 were evaluated with respect to occurrence of stream-like flaw and image quality in the same manner as in Example 1. The evaluation results are shown Table 4.

TABLE 4

| Sample No. | Backup roll No. | Number of Streak-like Flaws | Number of White Streaks | Remark |
|---|---|---|---|---|
| 201 | 2-1 | 1 | 2 | Inv. |
| 202 | 2-2 | 0 | 0 | Inv. |
| 203 | 2-3 | 0 | 0 | Inv. |
| 204 | 2-4 | 0 | 0 | Inv. |
| 205 | 2-5 | 0 | 0 | Inv. |
| 206 | 2-6 | 0 | 0 | Inv. |
| 207 | 2-7 | 1 | 2 | Inv. |

As apparent from Table 4, it was shown that performing abrasion of a photosensitive layer of a photoreceptor using a backup roll with a width of 40% to 70% of the width of the photosensitive layer and an abrasive tape with a width of 110% of a backup roll, resulted in superior performance in prevention of streak-like flaws and image quality. Effectiveness of the invention was thus confirmed.

Example 3

Preparation of Photoreceptor

A photoreceptor was prepared in the same manner as in Example 1.

Preparation of Backup Roll

There was prepared a backup roll which was the same as used in Example 1.

Preparation of Abrasive Member

Abrasive tapes 3-1 to 3-7 were prepared in the same manner as the abrasive tape 1-11 used in Example 1, except that the ratio of a width of abrasive tape to that of backup roll was varied, as shown Table 5.

TABLE 5

| Abrasive Tape No. | Width Ratio (%) of Abrasive Tape to Backup roll |
|---|---|
| 3-1 | 95 |
| 3-2 | 101 |
| 3-3 | 105 |
| 3-4 | 115 |
| 3-5 | 120 |
| 3-6 | 130 |
| 3-7 | 140 |

Abrasion

The prepared backup roll and the prepared abrasive tapes 3-1 to 3-7 were installed to an abrasive tape conveyance device of an abrading apparatus, as shown in FIG. 2*a*. Then, abrasion of the surface of a photosensitive layer of a photoreceptor was conducted under the same conditions as in Example 1, whereby photoreceptors were prepared and denoted as Samples 301 to 307.

Evaluation

The thus prepared samples 301 to 307 were evaluated with respect to occurrence of stream-like flaw and image quality in the same manner as in Example 1. The evaluation results are shown Table 6.

TABLE 6

| Sample No. | Abrasive Tape No. | Number of Streak-like Flaws | Number of White streaks | Remark |
|---|---|---|---|---|
| 301 | 3-1 | 1 | 0 | Inv. |
| 302 | 3-2 | 0 | 0 | Inv. |
| 303 | 3-3 | 0 | 0 | Inv. |
| 304 | 3-4 | 0 | 0 | Inv. |
| 305 | 3-5 | 0 | 0 | Inv. |
| 306 | 3-6 | 0 | 0 | Inv. |
| 307 | 3-7 | 1 | 2 | Inv. |

As apparent from Table 6, it was shown that performing abrasion of a photosensitive layer of a photoreceptor using a backup roll with a width of 80% of the width of the photosensitive layer and an abrasive tape with a width of 101 to 130% of a backup roll, resulted in superior performance in prevention of streak-like flaws and image quality. There was thus confirmed effectiveness of the invention.

Example 4

Preparation of Photoreceptor

A photoreceptor was prepared in the same manner as in Example 1.

Preparation of Backup Roll

Backup rolls 4-1 to 4-7 were prepared in the same manner as in the backup roll prepared in Example 1, except that a hardness was varied as shown in Table 7. The hardness was a value determined by using Askar Rubber Harness Tester type A (made by KOBUNSHI KEIKI Co., Ltd.). The hardness and of a backup roll and a material used for the backup roll were as below.

TABLE 7

| Backup roll No. | Hardness (°) | Material |
|---|---|---|
| 4-1 | 10 | Chloroprene rubber |
| 4-2 | 20 | Polyurethane rubber |
| 4-3 | 30 | Fluorine rubber |

TABLE 7-continued

| Backup roll No. | Hardness (°) | Material |
|---|---|---|
| 4-4 | 35 | Silicon rubber |
| 4-5 | 40 | Neoprene rubber |
| 4-6 | 50 | Butadiene rubber |

Preparation of Abrasive Member

There were prepared abrasive tapes which were each the same as abrasive tape No. 1-18 and have a width of 50% of the width of the respective backup rolls 4-1 to 4-6.

Abrasion

The thus prepared backup rolls 4-1 to 4-7 and the prepared abrasive tape were installed to an abrasive tape conveyance device of an abrading apparatus, as shown in FIG. 2*a*. Then, after loading the photoreceptor to a photoreceptor holding device, abrasion of the surface of a photosensitive layer of a photoreceptor was conducted under the same conditions as in Example 1, whereby photoreceptors were prepared and denoted as Samples 401 to 407.

Evaluation

The thus prepared samples 401 to 406 were evaluated with respect to occurrence of stream-like flaw and image quality in the same manner as in Example 1. The evaluation results are shown Table 8.

TABLE 8

| Sample No. | Backup roll No. | Number Of Streak-like Flaws | Number of White Streaks | Remark |
|---|---|---|---|---|
| 401 | 4-1 | 0 | 2 | Inv. |
| 402 | 4-2 | 0 | 0 | Inv. |
| 403 | 4-3 | 0 | 0 | Inv. |
| 404 | 4-4 | 0 | 0 | Inv. |
| 405 | 4-5 | 0 | 0 | Inv. |
| 406 | 4-6 | 1 | 0 | Inv. |

As apparent from Table 6, it was shown that performing abrasion of a photosensitive layer of a photoreceptor using a backup roll with a hardness of 20° to 40° and an abrasive tape with a width of 105% of the backup roll resulted in superior performance in prevention of streak-like flaws and image quality. There was thus confirmed effectiveness of the invention.

Example 5

Photoreceptors 5-1 to 5-7 were prepared in the same manner as in Example 1, except that a width of a non-photosensitive layer-forming portion was varied as shown in Table 9.

TABLE 9

| Photoreceptor No. | Width Of Non-photosensitive Layer Forming Portion (mm) |
|---|---|
| 5-1 | 0.2 |
| 5-2 | 0.5 |
| 5-3 | 1.0 |
| 5-4 | 5.0 |
| 5-5 | 10.0 |
| 5-6 | 20.0 |
| 5-7 | 25.0 |

Preparation of Backup Roll

There was prepared a backup roll which was the same as prepared in Example 1.

Preparation of Abrasive Member

There was prepared an abrasive tape which was the same as abrasive tape No. 1-25 prepared in Example 1 and have a width of 105% of the width of the prepared backup roll.

Abrasion

The prepared backup roll and the prepared abrasive tape were installed into an abrasive tape conveyance device of an abrading apparatus, as shown in FIG. 2*a*. Then, after loading the prepared each of the prepared photoreceptors 5-1 to 5-7 into a photoreceptor holding device, abrasion of the surface of a photosensitive layer of a photoreceptor was conducted under the same conditions as in Example 1, whereby photoreceptors were prepared, which were denoted as Samples 501 to 507.

Evaluation

The thus prepared samples 501 to 506 were evaluated with respect to occurrence of streak-like flaw and image quality in the same manner as in Example 1. The evaluation results are shown Table 10.

TABLE 10

| Sample No. | Photoreceptor No. | Number Of Streak-like Clauses | Number of White Streaks | Remark |
|---|---|---|---|---|
| 501 | 5-1 | 1 | 2 | Inv. |
| 502 | 5-2 | 0 | 0 | Inv. |
| 503 | 5-3 | 0 | 0 | Inv. |
| 504 | 5-4 | 0 | 0 | Inv. |
| 505 | 5-5 | 0 | 0 | Inv. |
| 506 | 5-6 | 0 | 0 | Inv. |
| 507 | 5-7 | 1 | 2 | Inv. |

As apparent from Table 10, it was shown that performing abrasion of photosensitive layers of photoreceptors with a non-photosensitive layer width of 0.5-20 mm by using an abrasive tape with a width of 105% of a backup roll, resulted in superior performance in prevention of streak-like flaws and image quality. There was thus confirmed effectiveness of the invention.

What is claimed is:

1. A surface abrading method of an electrophotographic photoreceptor comprising at least a photosensitive layer on an electrically conductive substrate, the method comprising abrading a surface of the photosensitive layer with an abrading member entrained about a backup roll with feeding the abrading member and rotating the electrophotographic photoreceptor, while moving the abrading member parallel to a rotating shaft of the electrophotographic photoreceptor with bringing the abrading member into contact with the surface of the photosensitive layer, wherein the abrading member comprises a solid body on a backing material, the solid body contains abrasive grains and is provided on a side of the backing material which is to be brought into contact with the photosensitive layer surface, and a top face of the solid body which is to be brought into contact with the photosensitive layer surface exhibits a surface roughness (Ry) of from 4.0 to 8.0 μm.

2. The surface abrading method of claim 1, wherein the backup roll has a width of 40 to 97% of a width of the photosensitive layer.

3. The surface abrading method of claim 1, wherein the abrading member has a width of 101 to 130% of the backup roll.

4. The surface abrading method of claim 1, wherein the backup roll exhibits a hardness of 20° to 40°.

5. The surface abrading method of claim 1, wherein the electrophotographic photoreceptor is provided with a non-photosensitive layer forming portion with a width of 0.5 to 20 mm on each edge of the conductive substrate.

6. The surface abrading method of claim 1, wherein an outermost layer of the electrophotographic receptor is a charge transport layer.

7. The surface abrading method of claim 1, wherein an outermost layer of the electrophotographic receptor is a protective layer.

8. The surface abrading method of claim 7, wherein the protective layer contains particles.

9. The surface abrading method of claim 8, wherein the particles are inorganic particles of at least one selected from the group consisting of silica, alumina, titanium oxide and strontium titanate

10. The surface abrading method of claim 1, wherein an outermost layer of the electrophotographic receptor contains a silicone oil.

* * * * *